US007717025B2

(12) United States Patent
Webster et al.

(10) Patent No.: US 7,717,025 B2
(45) Date of Patent: May 18, 2010

(54) FLUID ACTUATOR WITH LIMIT SENSORS AND FLUID LIMIT VALVES

(75) Inventors: Timothy David Webster, Flat C, 10/F, Block 11, Dawning Views, Fanling, Hong Kong (HK); Ashu M. G. Solo, Saskatoon (CA); Joe Zhou, Saskatoon (CA)

(73) Assignee: Timothy David Webster, Hong Kong (HK)

( * ) Notice: Subject to any disclaimer, the term of this patent is extended or adjusted under 35 U.S.C. 154(b) by 94 days.

(21) Appl. No.: 11/691,482

(22) Filed: Mar. 26, 2007

(65) Prior Publication Data

US 2007/0221054 A1 Sep. 27, 2007

Related U.S. Application Data

(60) Provisional application No. 60/743,796, filed on Mar. 27, 2006.

(51) Int. Cl.
*F15B 15/18* (2006.01)
*F01B 31/00* (2006.01)

(52) U.S. Cl. ..... 91/402; 92/181 P; 91/405

(58) Field of Classification Search ..... 91/400, 91/401, 402, 404, 405, 394, 395, 396; 92/8, 92/9, 10, 11, 12, 181 P
See application file for complete search history.

(56) References Cited

U.S. PATENT DOCUMENTS 3,999,463 A * 12/1976 Greenwood ..... 91/395
4,337,687 A * 7/1982 Hoover ..... 91/401
4,409,884 A * 10/1983 Boehringer ..... 91/401
4,463,563 A * 8/1984 Krehbiel ..... 91/402
5,425,305 A * 6/1995 Mauritz ..... 92/181 P
5,584,225 A * 12/1996 Arvidsson et al. ..... 91/405
6,135,434 A * 10/2000 Marking ..... 267/64.26
6,176,170 B1 * 1/2001 Uppgard et al. ..... 91/422
6,981,578 B2 * 1/2006 Leiphart et al. ..... 188/322.14

* cited by examiner

*Primary Examiner*—Thomas E Lazo

(57) ABSTRACT

A fluid actuator with fluid limit valves (550, 551) and adjustable mechanical limits enables the construction of fluid linkages which are able to completely replace mechanical linkages. In a fluid circuit comprising of two or more fluid actuators, the pistons (102) of the fluid actuators can become uncorrelated when fluid leakage occurs. At the piston (102) extension and retraction limits, fluid limit valves (550, 551) open. The open fluid limit valves (550, 551) allow fluid to bypass pistons (102) and/or allow fluid from an external source to compensate the fluid leakage. The fluid bypassing pistons (102) at their extension or retraction limit and/or externally supplied fluid forces the uncorrelated pistons (102) to reach their extension or retraction limit as well. The fluid actuator with adjustable mechanical limits have one or more additional pistons (686, 688), which have an adjustable separation from the main piston (102) or end of cylinder. The fluid actuator with fluid limit valves (550, 551) and adjustable mechanical limits enables mechanical linkages to be replaced by fluid circuits composed of the fluid actuators.

22 Claims, 18 Drawing Sheets

FLUID ACTUATOR WITH LIMIT SENSORS AND FLUID LIMIT VALVES

CROSS-REFERENCE TO RELATED APPLICATIONS

Figure 1:
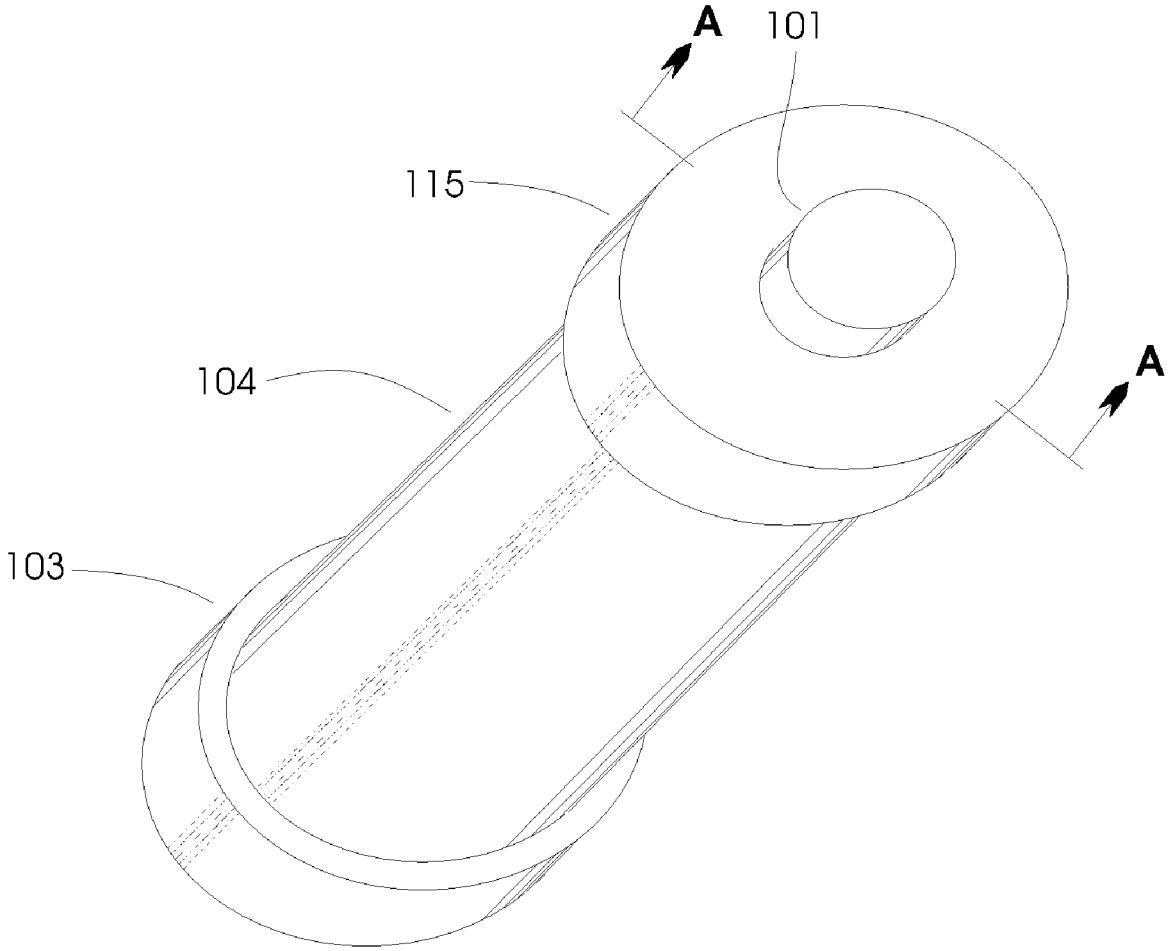
FIG 1 PRIOR ART

This application is derived in part from the provisional patent Application No. 60/743,796 filed Mar. 27, 2006

BACKGROUND OF THE INVENTION

1. Field of Invention

This invention relates the construction of a valve for hydraulic fluid leak detection and correction in hydraulic fluid linkages, insuring that the hydraulic fluid linkages are accurate at all times. The reliable accurate hydraulic fluid linkages with adjustable limit stops can be used to replace complex mechanical linkages.

2. Description of Prior Art

Hydraulic circuits have not been able to fully replace mechanical linkages in precision applications, such as vehicle steering and other systems requiring accurate reliable correlation which linkages provided. Mechanical linkages reliably correlate the movement of mechanical components. Hydraulic circuits used to replace mechanical linkages use two or more linear actuators, rotary actuators or fluid motors to control the movement of mechanical components. In a hydraulic circuit these hydraulic actuators or motors are connected by a hydraulic fluid conduit with possible intermediary fluid control valves and fluid pumps. The hydraulic circuits used to replace mechanical linkages are hydraulic linkages. Replacing mechanical linkages with hydraulic linkages have significant advantages over mechanical linkages. Hydraulic conduits required to construct hydraulic linkages can be easily routed. Hydraulic circuits can easily switch operating modes. In each operation mode the hydraulic circuit can form a hydraulic linkage between a different set of mechanical components or the mechanical components can be controlled independently in a completely uncorrelated manner. To replace mechanical linkages, hydraulic circuits need to be able to detect and correct fluid loss in hydraulic linkages and require limit stops to prevent damage caused by extending or retracing too far and/or too hard. Through the use of limit sensors and fluid limit valves, the hydraulic linkage can include leakage compensation and leakage location detection and allow for accurate control over the extension and retraction of a piston in the fluid actuator. Mechanical stops prevent over extension and over retraction and are strong enough to resist the full force of the hydraulic actuator or the full force of the mechanical load. Conventional actuators include mechanical stops. However, the mechanical stops included in conventional actuators are not adjustable. Mechanical components in different orientations may require mechanical limit stops to be repositioned. Without adjustable mechanical actuator stops, actuator movement often cannot be stopped before damaging over extension or over retraction occurs.

Piston bypass valves have been constructed to activate the piston when it is in proximity to the end cap. For example, see U.S. Pat. Nos. 5,425,305, 6,170,383 (Mauritz). The described art does not provide location adjustable piston bypass valves.

Re-phasing hydraulic circuits have been constructed of re-phasing cylinders utilizing fluid bypass ports. For example, see U.S. Pat. No. 4,463,563 (Krehbiel). The described art does not provide location adjustable piston bypass valves. Also, neither the location nor the pressure at which these pistons are re-phased, by means of a bypass port, is adjustable.

Hydraulic steering linkages have been constructed from a pair of hydraulically linked hydraulic cylinders. For example see U.S. Pat. Nos. 6,179,315 (Boriack) 3,212,793 (Pietrotroia). There is no means of detecting or correcting for hydraulic fluid leakage from the hydraulic linkage described in this prior art. Hydraulic leakage occurs in virtually all hydraulic circuits. Leakage can occur as hydraulic fluid lost from the hydraulic circuit, or as hydraulic fluid leaking across actuator seals.

Cushioning devices are constructed for decelerating and stopping pistons by restricting fluid flow. For example, see U.S. Pat. Nos. 4,397,218 (Spring), 6,557,456 (Norton). The presented cushioning devices do not include a means of adjusting the extension and/or retraction limits at which the cushioning limit valves are activated or proportionally activating the cushioning limit valves.

A limit switch with a sensing element is actuated when the operating actuator reaches an end position. The switching element stops the supply of hydraulic fluid to the operating actuator in response to the actuated sensing element. For example see U.S. Pat. Nos. 3,920,217 (Danfoss) and 3,941,033 (Danfoss). Proximity switches are used to detect the proximity of components before they come into contact. When proximity switches detect the limit position, valves are controlled to interrupt hydraulic supply to actuators preventing them from over extending or retracting. For example U.S. Pat. No. 4,165,674 (Weight). Rather than stopping or interrupting the hydraulic supply to actuators, the hydraulic flow can also be reduced, slowing the actuators' movement as it approaches the limit. A limit valve which controls the driving hydraulic flow by reducing the hydraulic pump stroke when the limit valve is moved to a predetermined limit is able to reduce the hydraulic flow as desired. For example see U.S. Pat. No. 5,117,935 (Hall). However, the limit sensors and valves designed to stop or reduce hydraulic supply to actuators cannot detect or correct hydraulic leakage in circuits. Separate mechanical stops are required to prevent mechanical loads from over extending or retracting the actuators.

Leakage in hydraulic linkages can be compensated by continuously monitoring the position by a sensor on the control element and by a sensor on the driven element. The hydraulic flow to the actuators is continuously adjusted according to the monitored positions of the control and driven element. For example U.S. Pat. No. 7,028,469 (Porskrog). Here the elements are linked by an electronic control system. This electronic monitoring system requires an electrical power supply at all times for the position sensors and the control valve solenoids. The electronic monitoring systems is only able to compensate for slow hydraulic leaks. The present invention is able to compensate for slow hydraulic leaks without requiring continuous monitoring of either the control or driven elements. The prior art method of compensating for hydraulic leaks by continuously monitoring the control and driven elements does not include adjustable mechanical stops required to prevent mechanical loads from over extending or retracting the actuators. Whereas the present invention does include adjustable mechanical stops.

OBJECTS AND ADVANTAGES

The present invention enables mechanical linkages to be replaced by hydraulic linkages in precision applications such as vehicle steering and other systems requiring accurate reliable correlation between mechanical components. The present invention integrates adjustable mechanical stops or cushions into hydraulic actuators. This allows hydraulic linkages to be used in operating situations where over limit movement must be prevented. The present invention enables detection and correction of hydraulic leakage at actuator's extension and retraction limits. Slow hydraulic leaks do not require continuous monitoring. Intermittent detection and correction of hydraulic leakage is sufficient. The present invention does not require a hydraulic source to be constantly available to correct for hydraulic leakage. More time is available to recharge the hydraulic pressure source between its usage for hydraulic leakage correction. The present invention provides hydraulic leakage detection and correction without the requirement of continuous monitoring and an electronic control system. As a result hydraulic linkages constructed are simpler and more reliable and can be safely used as a replacement for mechanical linkages.

SUMMARY

In accordance with the present invention, a fluid linkage circuit with limit sensors is integrated into a fluid actuator, such that when the fluid actuator extends to its extension limit or retracts to its retraction limit, the limit sensors will activate fluid valves to redirect fluid to bypass the fluid actuator's piston, thereby preventing over extension or over retraction and correcting for fluid leakage within a fluid linkage circuit. The location of the limit sensors are adjusted by adjusting the mechanical limit stops or cushions of the fluid actuator.

DRAWINGS

Figures

FIG. 1 Isometric view of a Prior Art Fluid Actuator.

Figure 2:
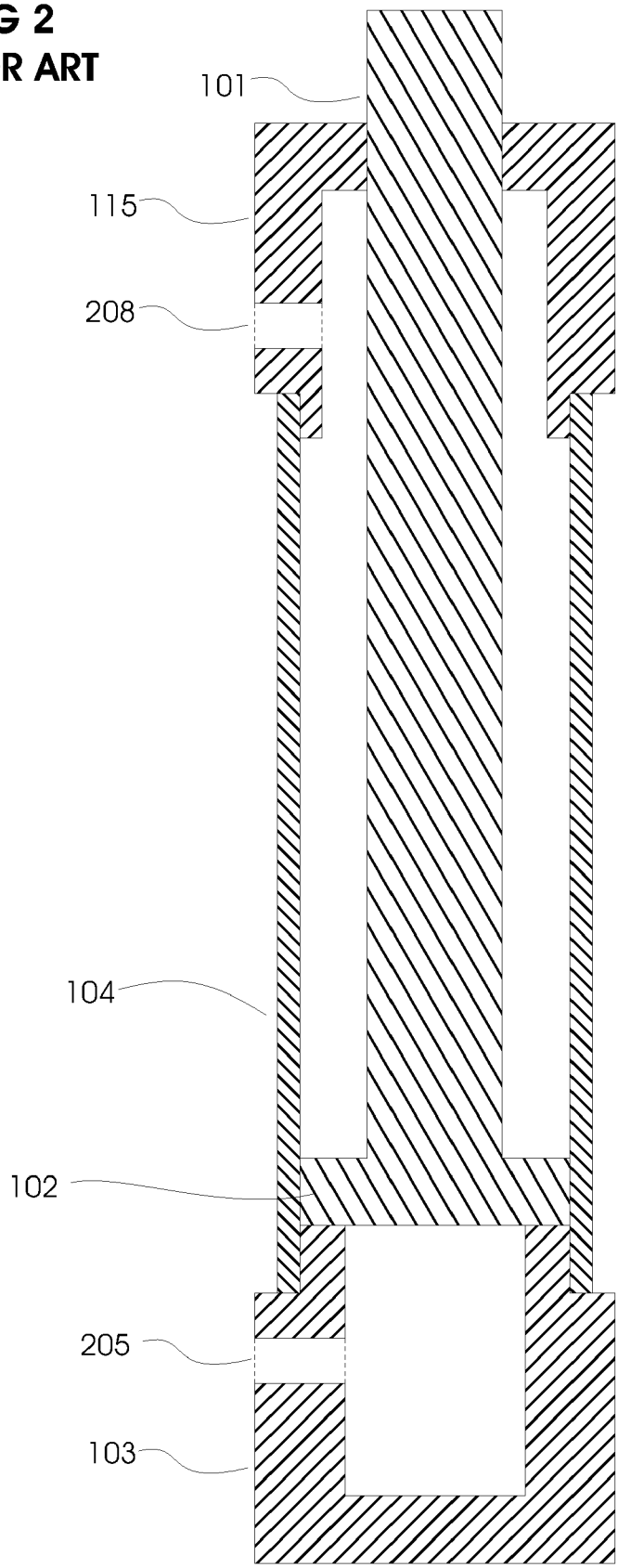
FIG 2 PRIOR ART

FIG. 2 Cross Section view of the Prior Art Fluid Actuator shown in FIG. 1 taken along Cutting Plane A-A.

Figure 3:
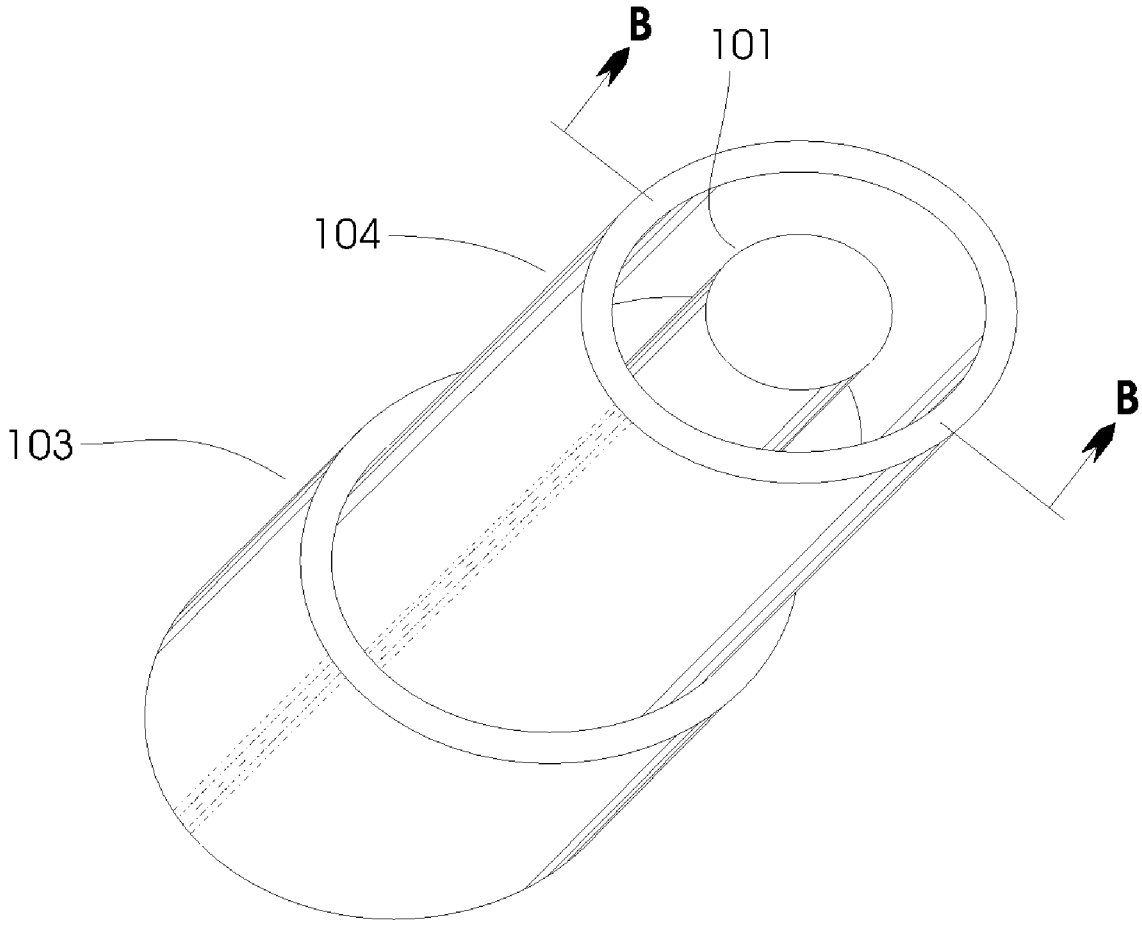
FIG 3 PRIOR ART

FIG. 3 Isometric view of the Base Portion of the Prior Art Fluid Actuator shown in FIG. 1

Figure 4:
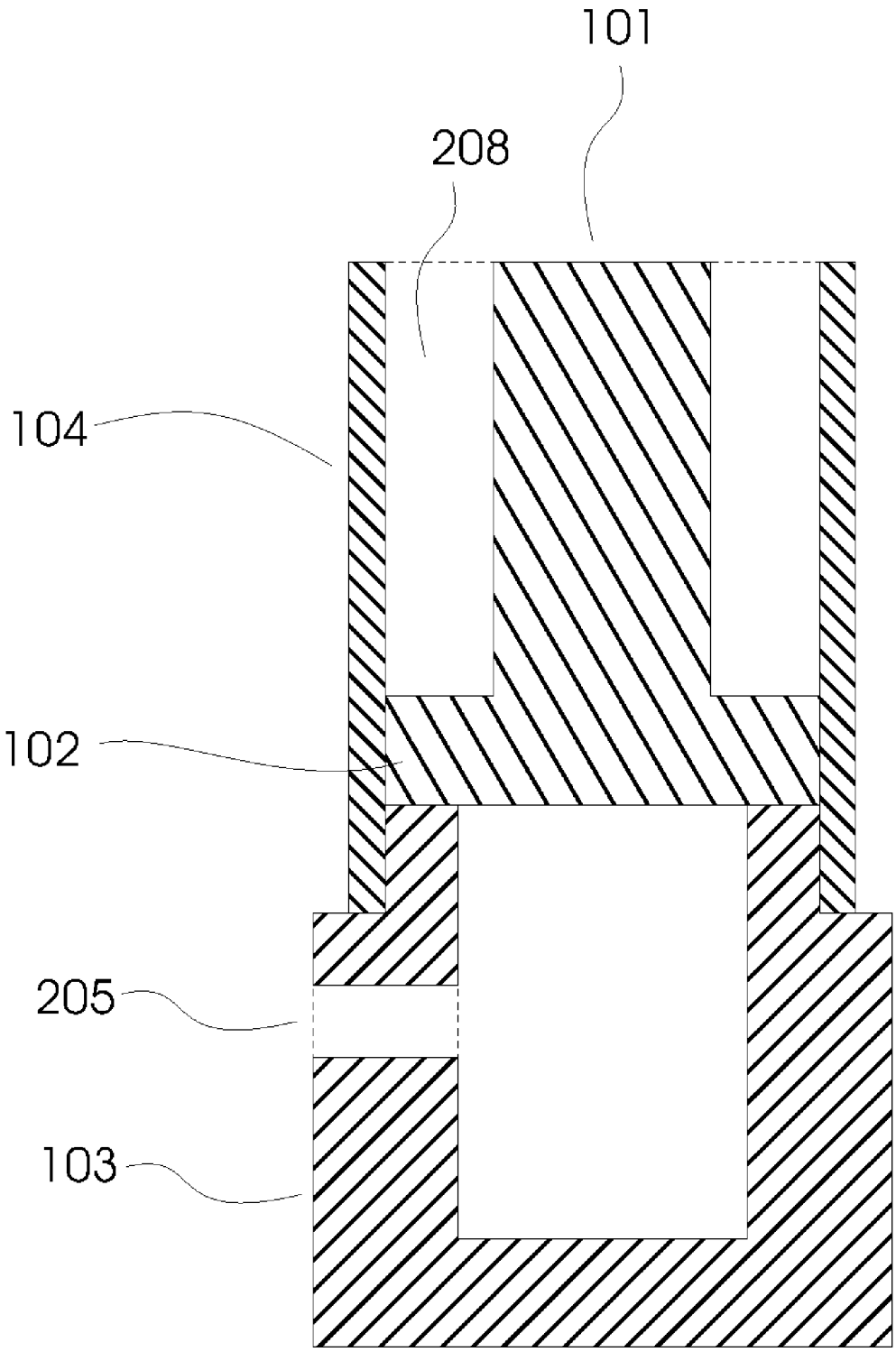
FIG 4 PRIOR ART

FIG. 4 Cross Section view of the Base Portion of the Prior Art Fluid Actuator shown in FIG. 2 taken along Cutting Plane B-B.

Figure 5:
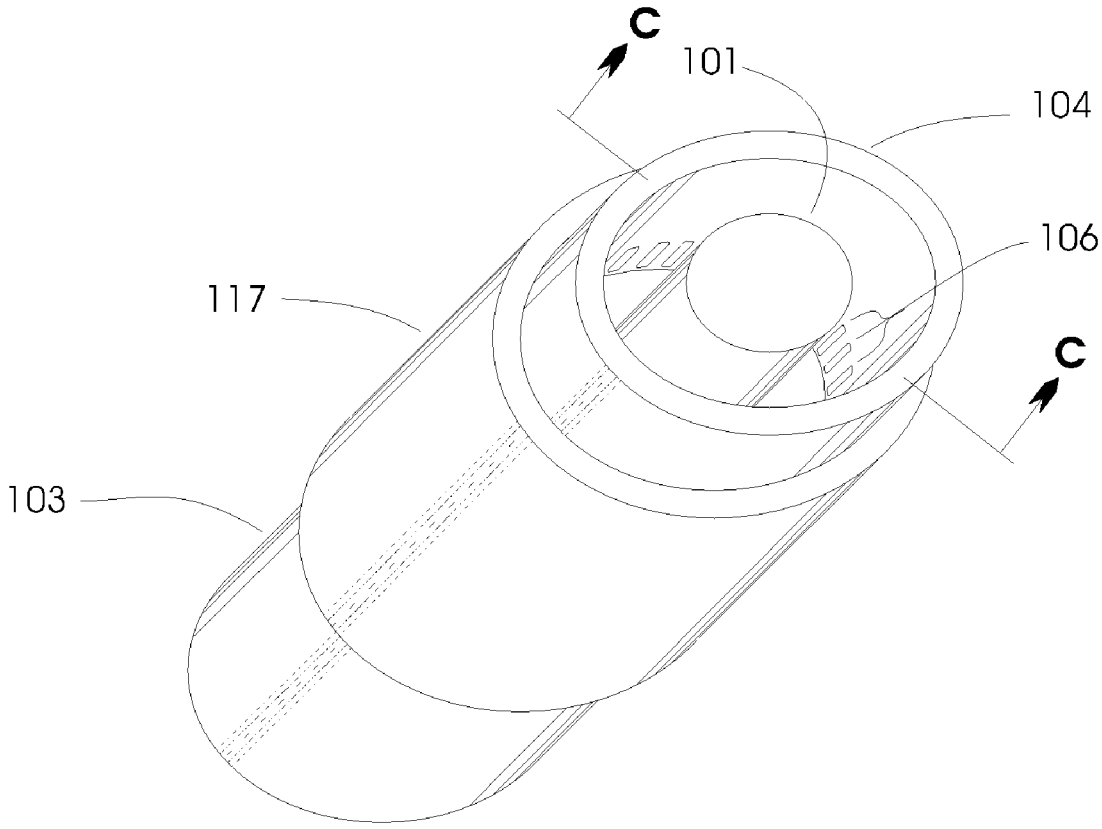

FIG. 5 Isometric view of the Base Portion of the Fluid Actuator with an Integrated Fluid Limit Valve that has No Moving Parts.

Figure 6:
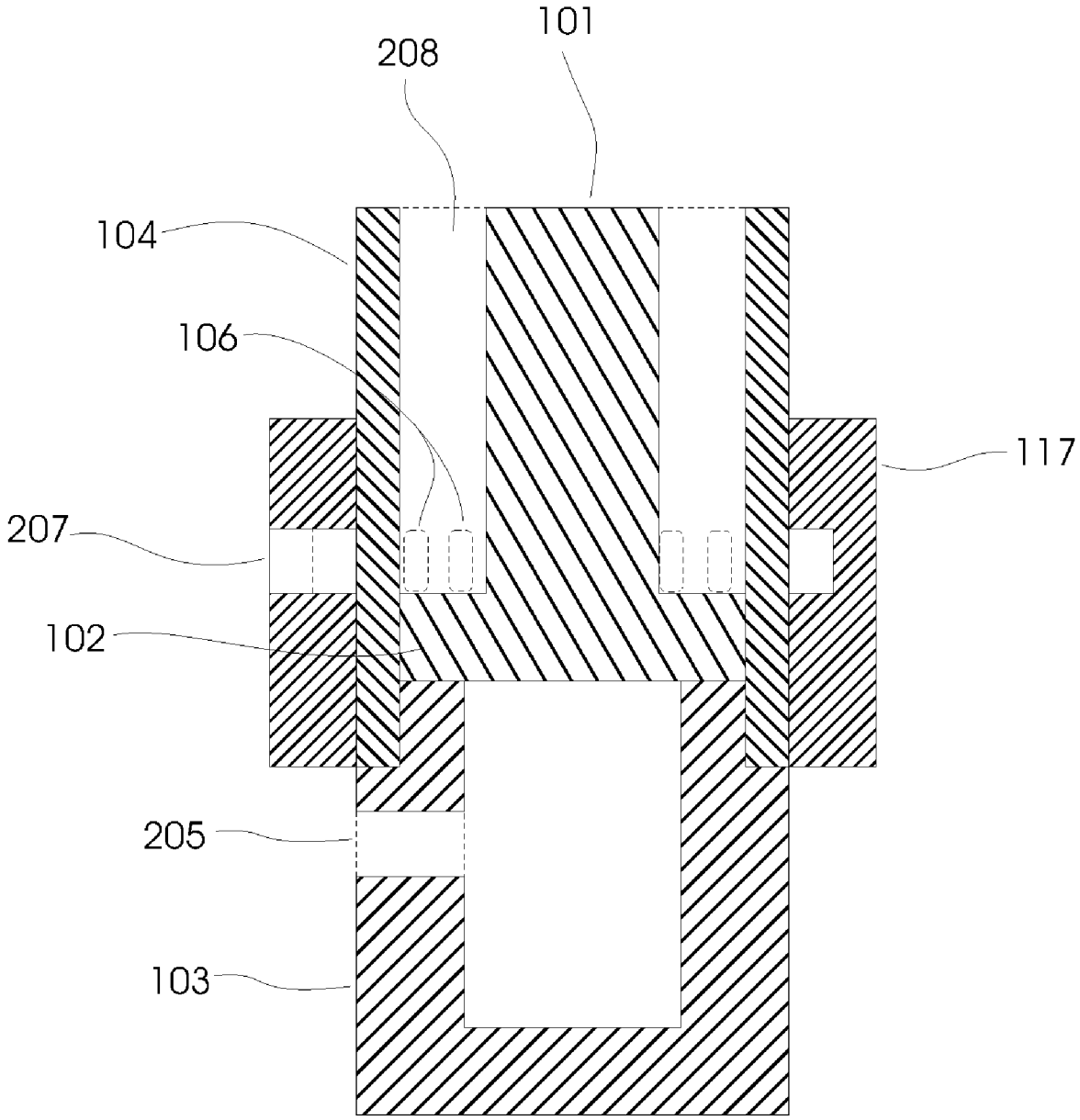

FIG. 6 Cross Section view of the Base Portion of the Fluid Actuator with an Integrated Fluid Limit Valve that has No Moving Parts shown in FIG. 5 taken along Cutting Plane C-C.

Figure 7:
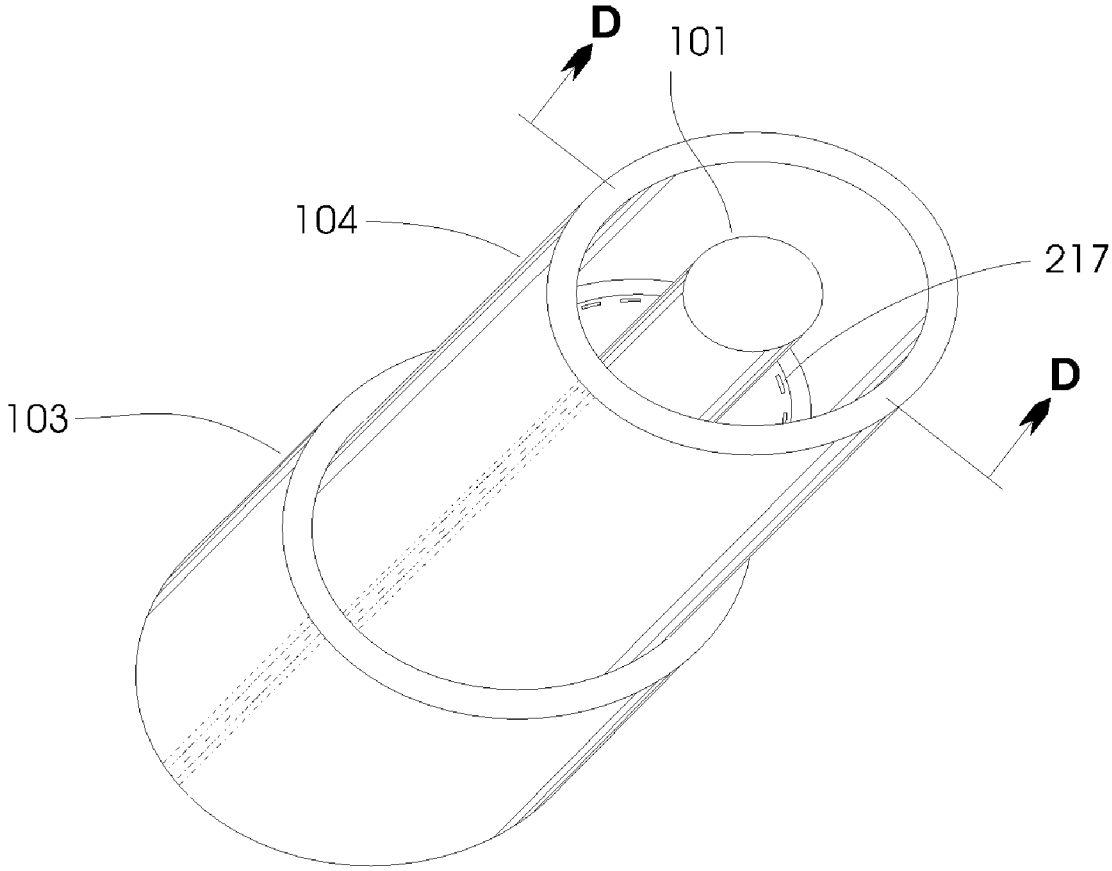

FIG. 7 Isometric view of the Base Portion of the Fluid Actuator with a Fluid Limit Valve integrated into the Piston.

Figure 8:
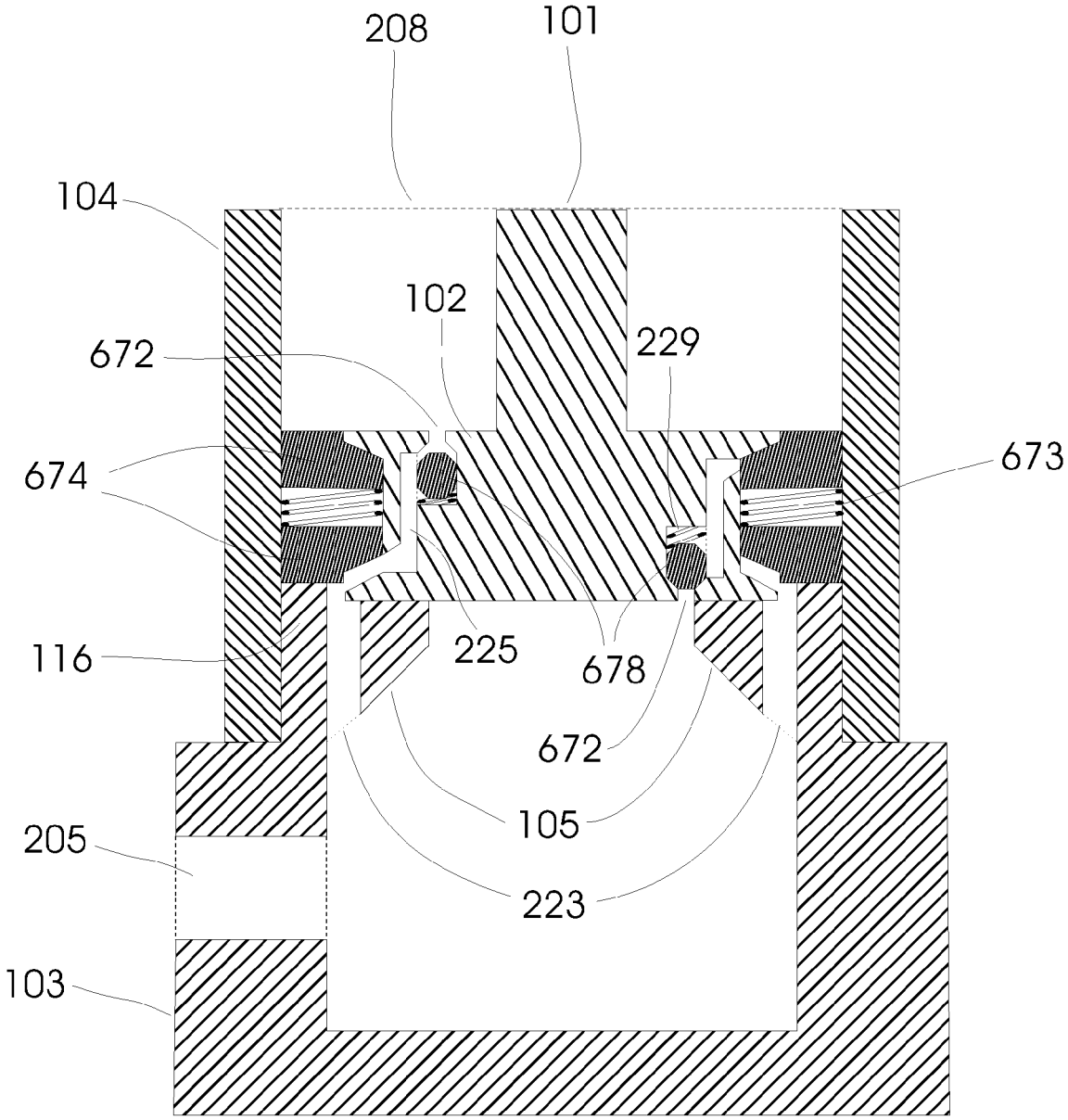

FIG. 8 Cross Section view of the Base Portion of the Fluid Actuator with a Fluid Limit Valve integrated into the Piston shown in FIG. 7 taken along Cutting Plane D-D.

Figure 9:
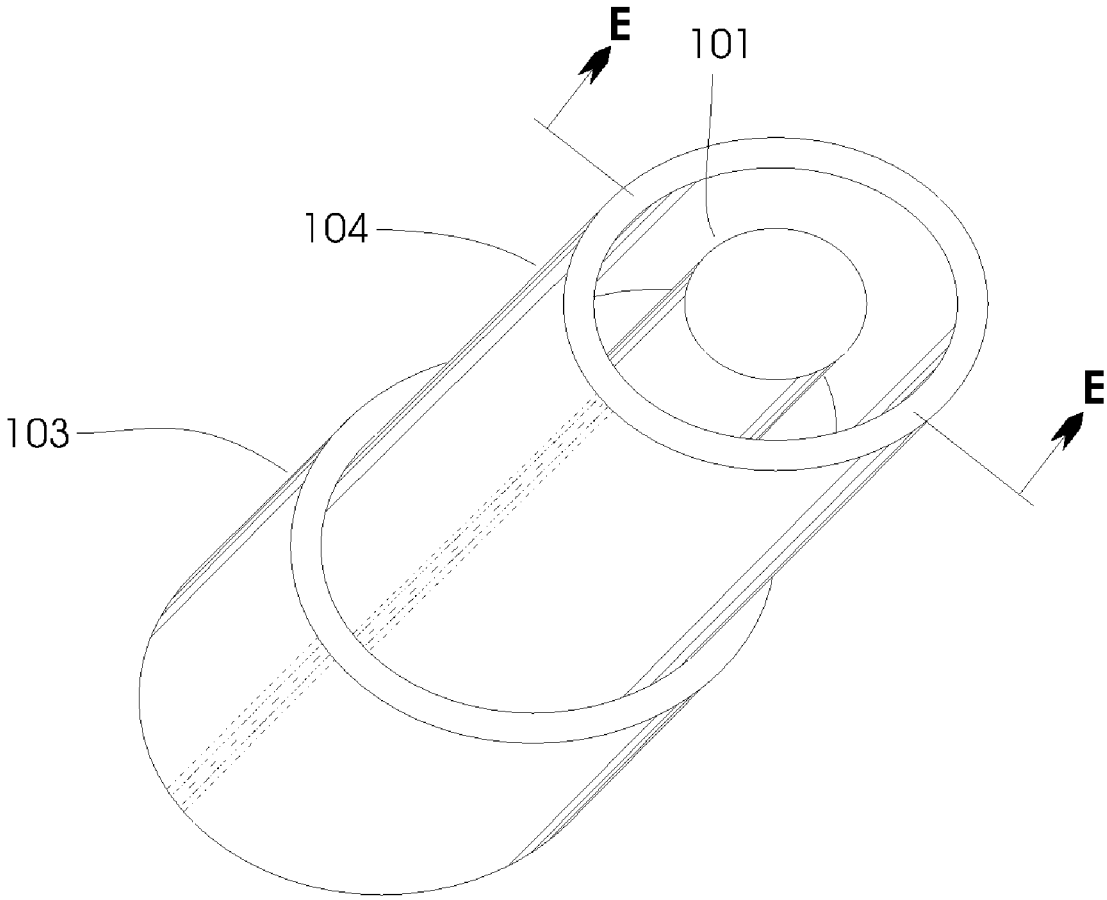

FIG. 9 Isometric view of the Base Portion of the Fluid Actuator with a Fluid Limit Valve integrated in the End Cap.

Figure 10:
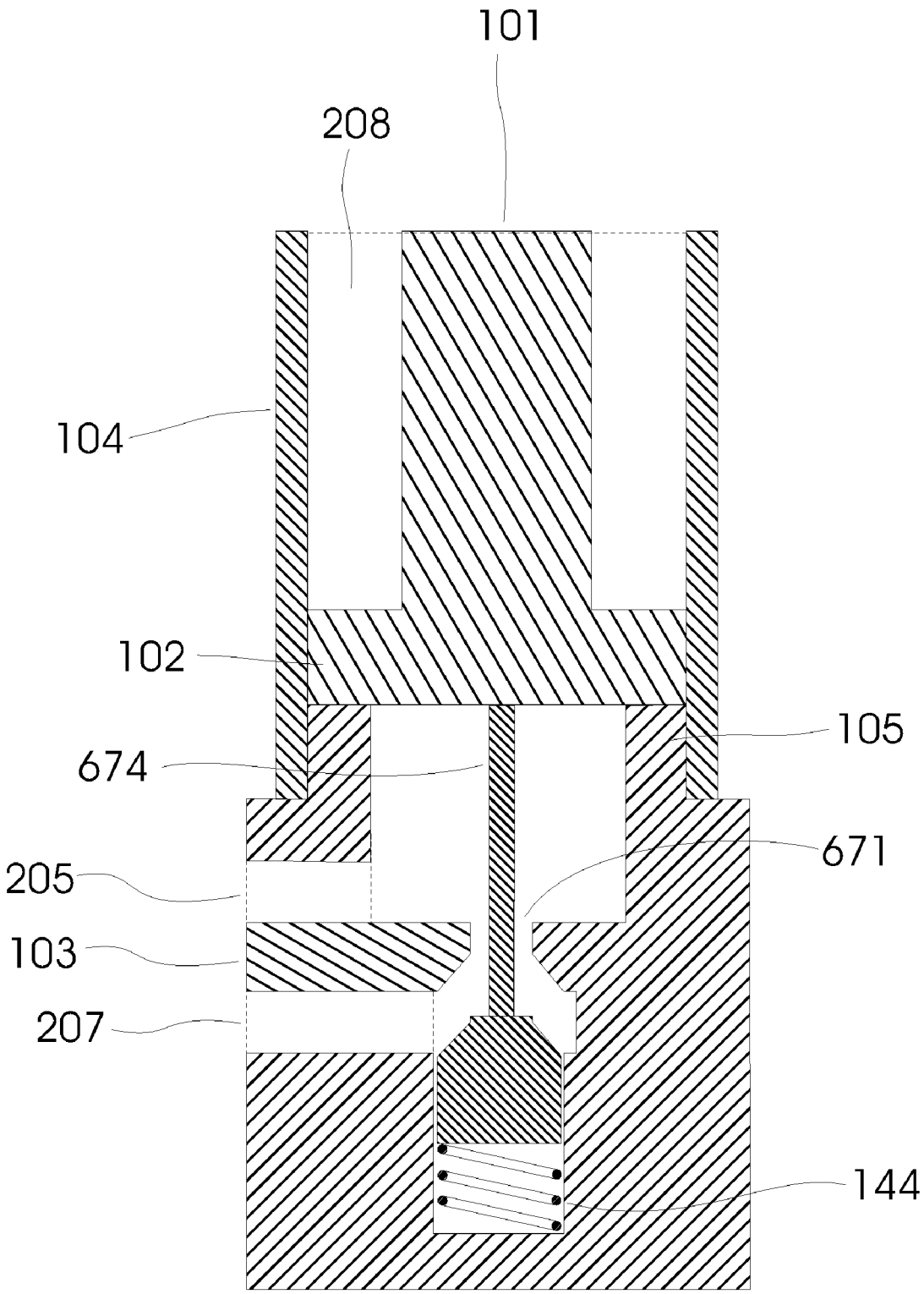

FIG. 10 Cross Section view of the Base Portion of the Fluid Actuator with a Fluid Limit Valve integrated in the End Cap shown in FIG. 9 taken along Cutting Plane E-E.

Figure 11:
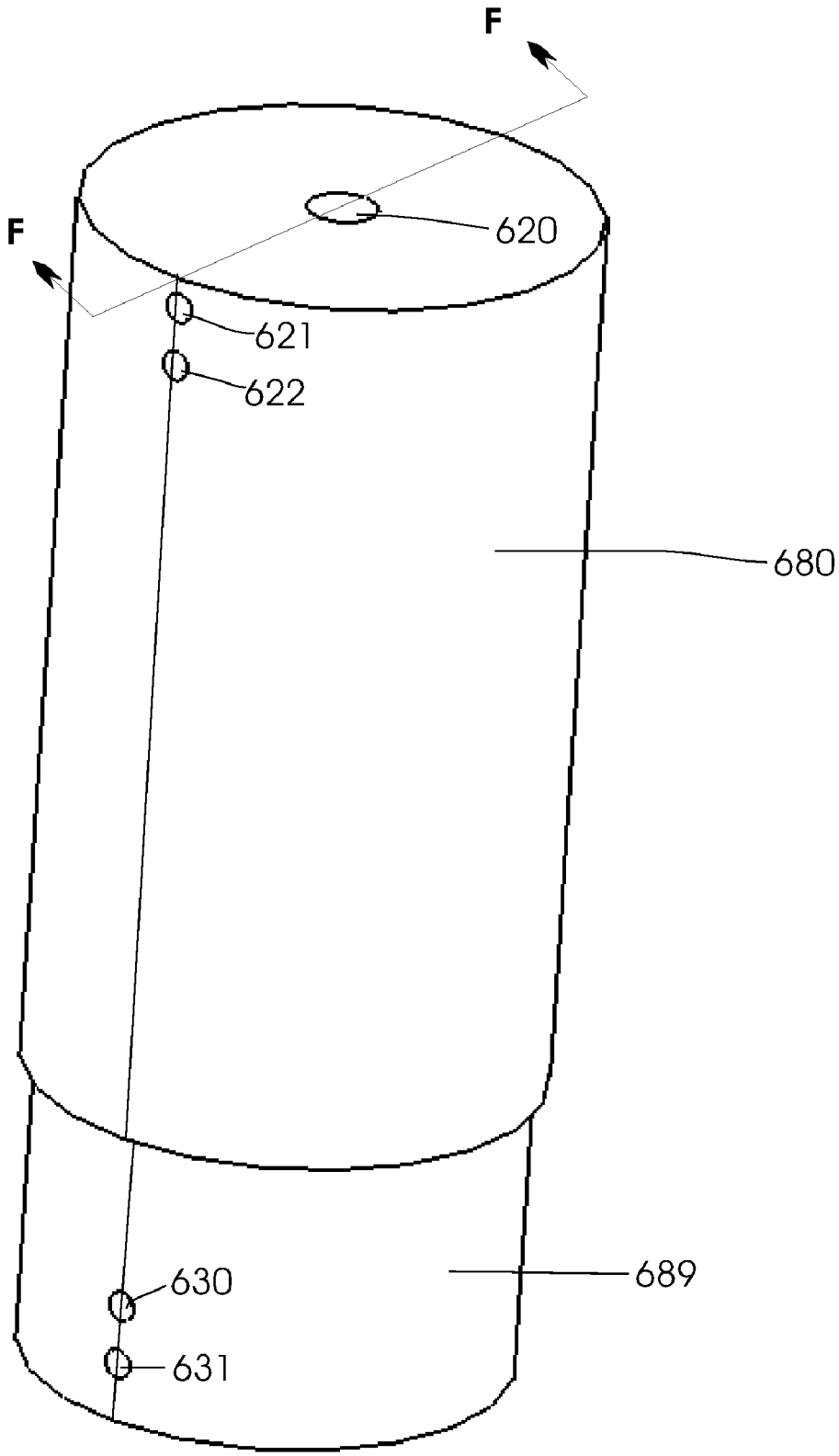

FIG. 11 Isometric view of the Hydro Pneumatic Cylinder with Adjustable Mechanical Limits.

Figure 12A:
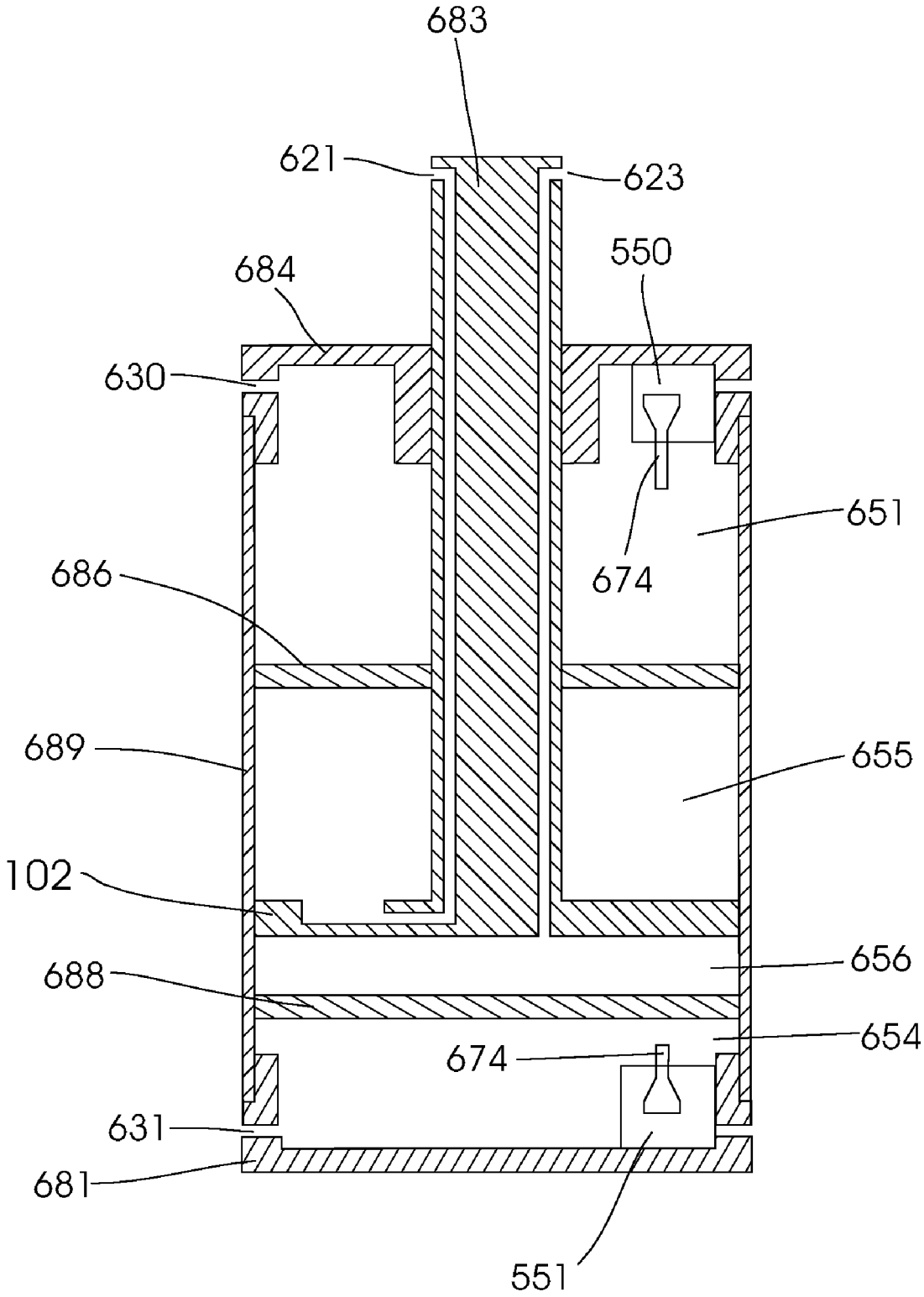
Figure 12B:
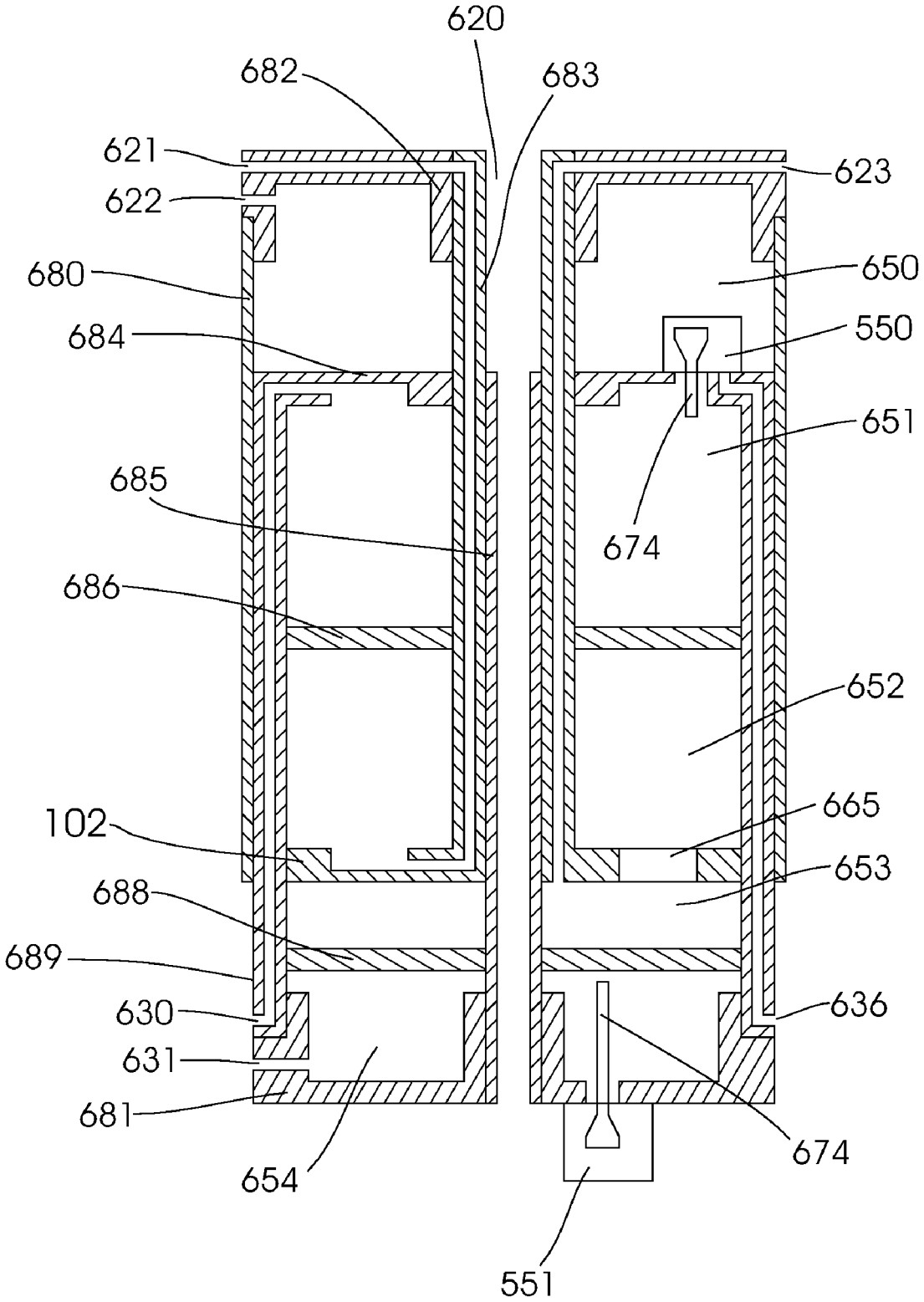
Figure 13A:
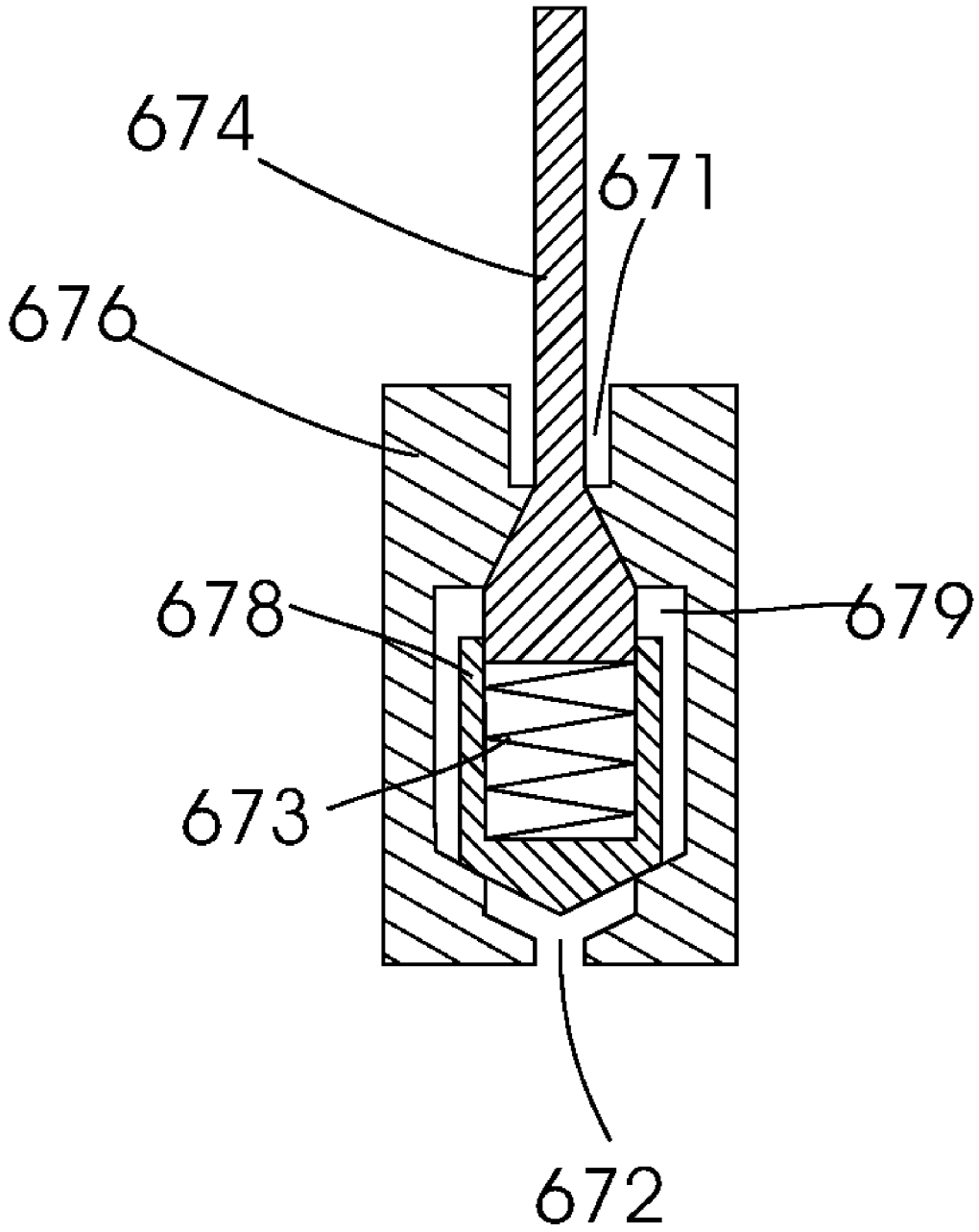
Figure 13B:
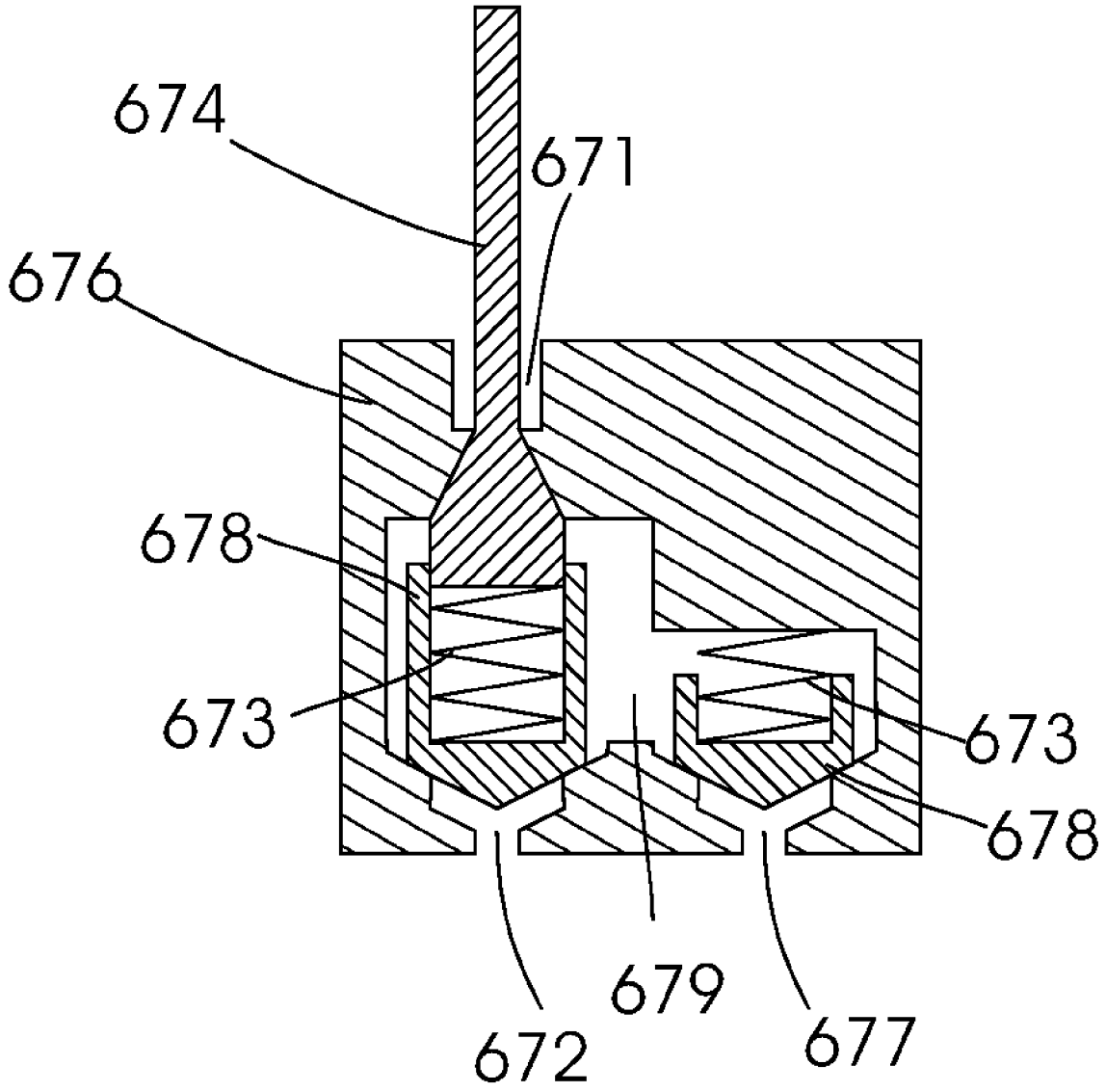
Figure 14:
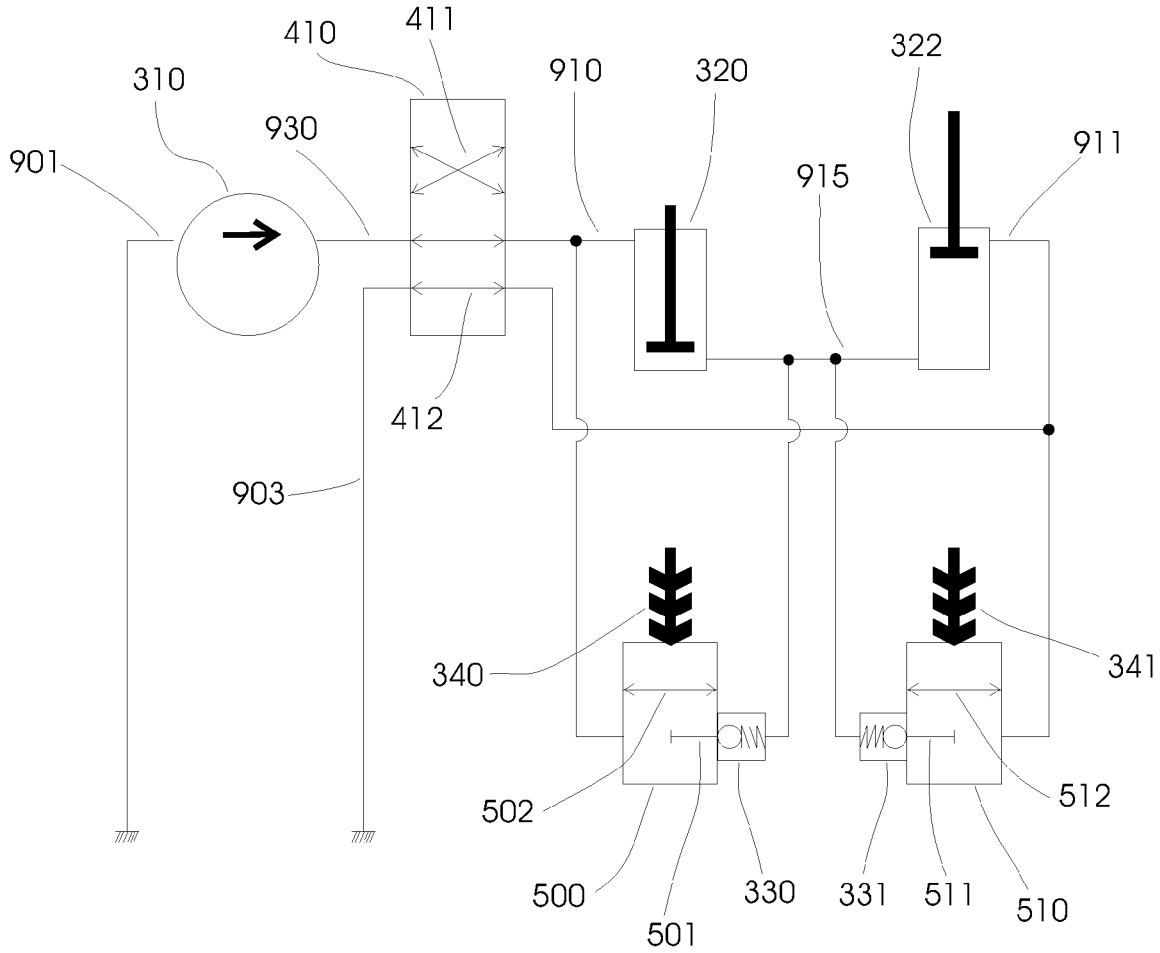
Figure 15:
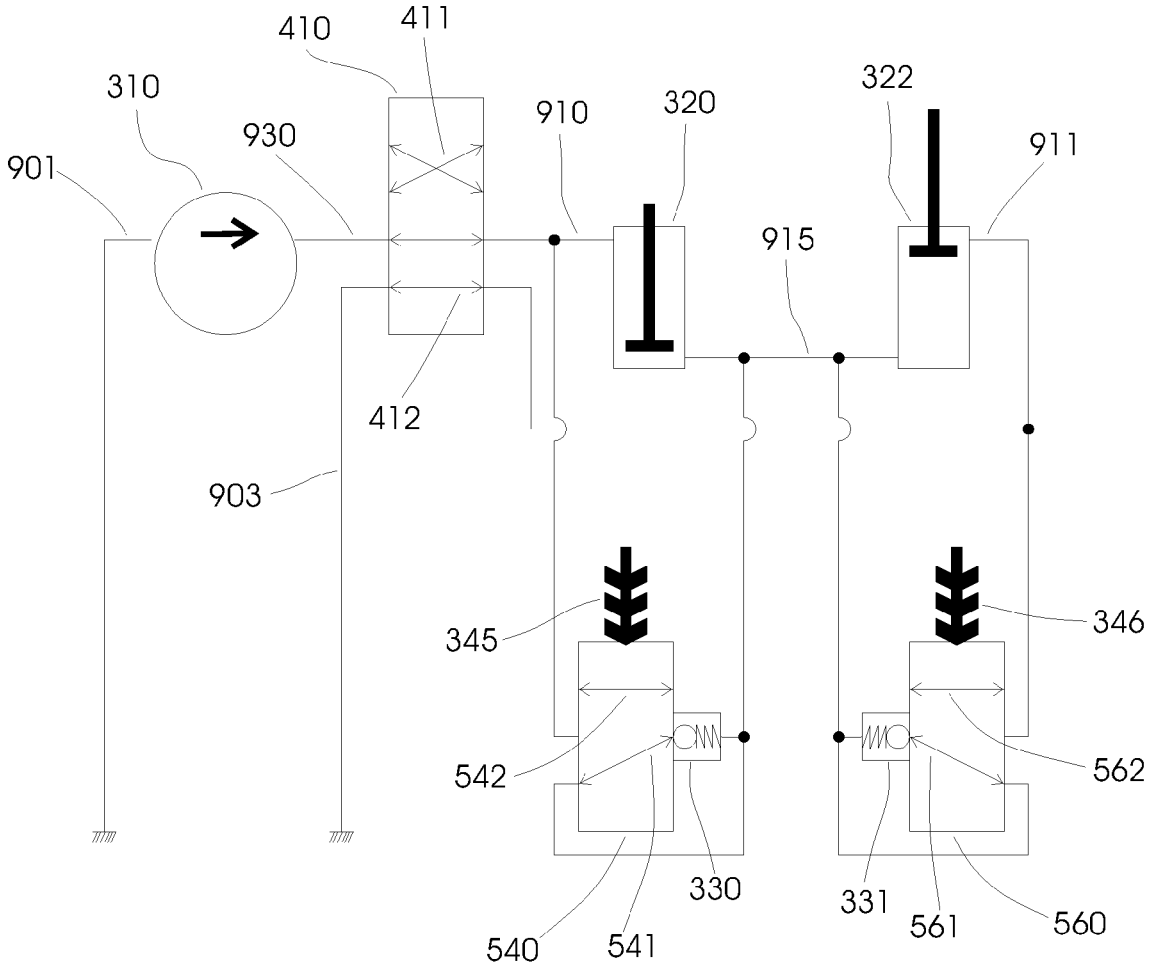
Figure 16:
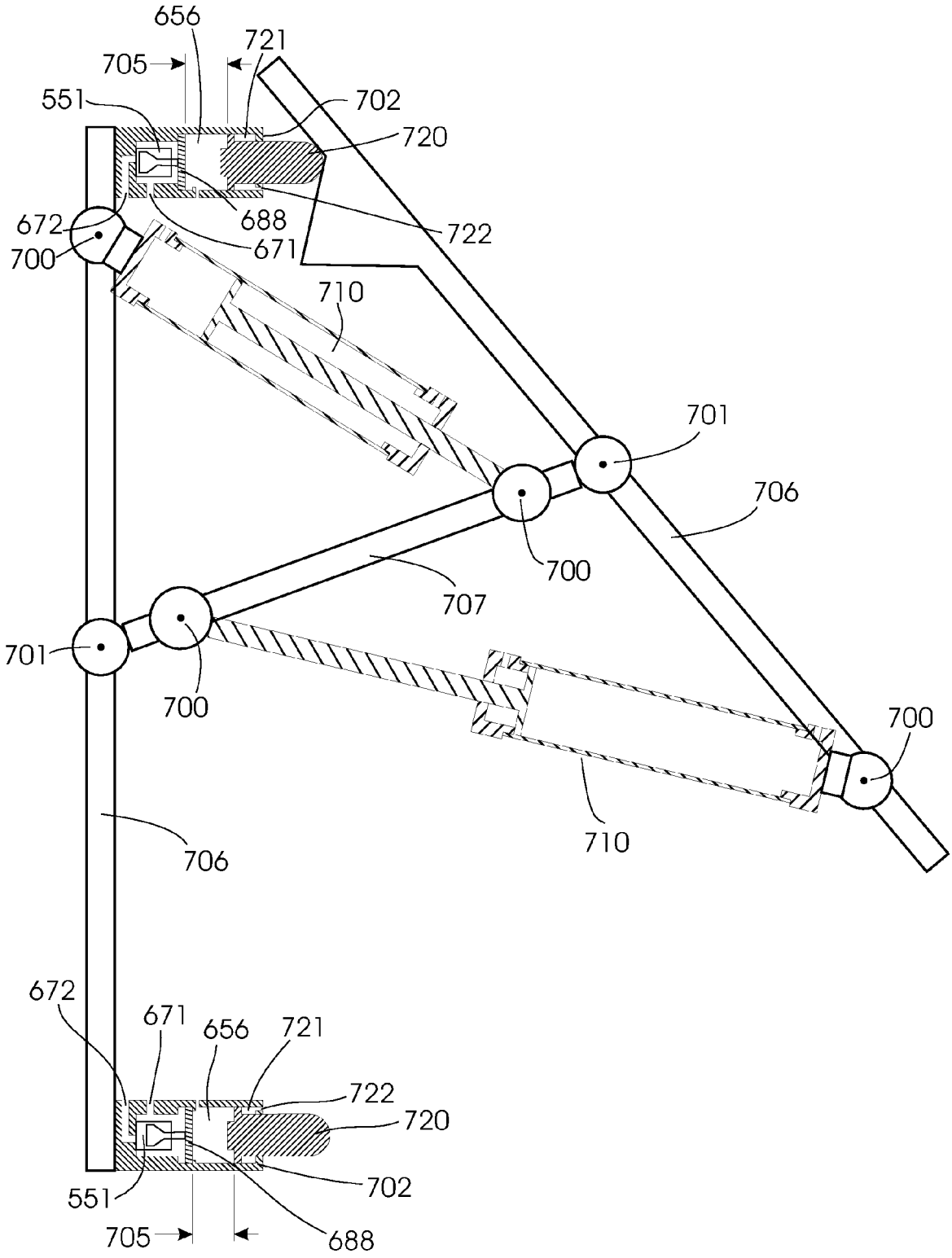

FIG. 12*a* Cross Section of Hydraulic Cylinder with Adjustable Mechanical Limits shown in FIG. 11 taken along Cutting Plane F-F FIG. 12*b* Cross Section of Hydro Pneumatic Cylinder with Adjustable Mechanical Limits shown in FIG. 11 taken along Cutting Plane F-F FIG. 13*a* Detailed Side Cross Section of Fluid Limit Valve shown in FIG. 12*a*, FIG. 12*b* which is taken along Cutting Plane F-F FIG. 13*b* Detailed Side Cross Section of Fluid Limit Valve with External Fluid Leakage Correction Supply shown in FIG. 12*a*, FIG. 12*b* which is taken along Cutting Plane F-F FIG. 14 Basic fluid linkage utilizing the Fluid Limit Valve With Moving Parts FIG. 15 Basic fluid linkage utilizing the Fluid Limit Valve Without Moving Parts FIG. 16 Fluid Actuators with External Mechanical Limit Stops

REFERENCE NUMERALS

101 piston rod
102 main piston
103 end cap for cylinder base
104 cylinder tube
105 base end cap piston stop
106 base fluid limit valve outlet holes
115 end cap for cylinder head
116 base poppet plunger of bidirectional fluid limit valve
117 base fluid limit valve cover
144 poppet return spring of fluid limit valve
205 line to cylinder base connection
207 fluid limit valve outlet
208 line to cylinder head connection
223 base end cap ports for poppet fluid limit valve
225 poppet fluid limit valve bypass port
229 return spring of check ball
310 high-pressure fluid pump
320 fluid actuator
322 fluid actuator
330 fluid check valve
331 fluid check valve
340 mechanical limit sensor that can apply force to fluid limit valve 500
341 mechanical limit sensor that can apply force to fluid limit valve 510
345 mechanical limit sensor that can apply force to fluid limit valve 550
346 mechanical limit sensor that can apply force to fluid limit valve 560
410 fluid control valve
411 fluid control valve crossover line
412 fluid control valve straight-through line
500 fluid limit valve with moving parts
501 fluid limit valve 500 in disconnect state
502 fluid limit valve 500 in connect state
510 fluid limit valve with moving parts
511 fluid limit valve 510 in disconnect state
512 fluid limit valve 510 in connect state
540 fluid limit valve without moving parts
541 fluid limit valve 540 in self-connect state
542 fluid limit valve 540 in through-connect state
550 head limit sensor and fluid limit valve
551 base limit sensor and fluid limit valve
555 counter balance valve
560 fluid limit valve without moving parts
561 fluid limit valve 560 in self-connect state
562 fluid limit valve 560 in through-connect state
620 internal piston hydraulic pump
621 head gas or hydraulic head chamber inlet
622 piston gas inlet
623 base gas or hydraulic base chamber inlet
630 head hydraulic inlet
631 base hydraulic inlet
636 hydraulic lines manufactured into cylinder body 689
650 outer head gas chamber
651 head chamber
652 head chamber
653 base chamber
654 base chamber
655 hydraulic adjustable head chamber
656 hydraulic adjustable base chamber
665 gas damping valve or fluid limit valve

671 fluid limit valve outlet
672 fluid limit valve inlet
673 fluid limit valve return spring
674 fluid limit valve poppet plunger
676 fluid limit valve body
677 fluid leak correction supply inlet
678 check valve plunger or ball
679 fluid limit valve cavity
680 cylinder head shell
681 base cap with base stops
682 head cap with head stops
683 piston shaft
684 head cap with head stops
685 base piston stub
686 hydraulic floating head piston
688 hydraulic floating base piston
689 cylinder body
700 hydraulic cylinder mounting joint
701 separated pivot joint
702 adjustable mechanical limits
705 separation between floating base piston 688 and mechanical limit piston 720
706 side frame
707 pivot connecting frame
710 prior art hydraulic cylinder shown in FIG. 2
720 mechanical limit piston
721 head chamber
722 vent
901 fluid pump 310 intake line from fluid reservoir
903 low-pressure return line from fluid control valve to fluid reservoir
910 high-pressure line from fluid control valve to head connection of fluid actuator 320 and to the fluid limit valve
911 high-pressure line from fluid control valve to head connection of fluid actuator 322 and to fluid limit valve
915 high-pressure line connecting base connection of fluid actuators 320 and 322 to fluid limit valves and fluid check valves
930 high-pressure line from fluid pump 310 to fluid control valve

DETAILED DESCRIPTIONS OF PRIOR ART EMBODIMENTS AND THEIR OPERATIONS

FIGS. 1 and 2

Description of Complete Prior Art Fluid Actuator

Fluid actuators are used to extend and/or retract in order to displace a load. FIG. 1 is an isometric view of a complete prior art fluid actuator. FIG. 2 is a sectional view taken along the cutting plane A-A of FIG. 1.

FIGS. 1 and 2

Operation of Complete Prior Art Fluid Actuator

Fluid flowing into cylinder base connection 205 forces piston 102 to move and piston rod 101 to extend. When the piston 102 moves and the piston rod 101 extends, fluid is forced out of the cylinder head connection 208. Fluid flowing into the cylinder head connection 208 forces piston 102 to move and piston rod 101 to retract. When the piston 102 moves and the piston rod 101 retracts, fluid is forced out of the cylinder base connection 205. The prior art fluid actuator has a fluid connection 205 in the base and another fluid connection 208 in the head. The piston 102 does not pass over either the base 205 or the head 208 connection. The base connection 205 is always on the base side of the piston 102. And the head connection 208 is always on the head side of the piston 102. When the prior art fluid actuator is operating as designed, fluid does not flow from the head side of the piston 102 to the base side of the piston 102.

FIGS. 3 and 4

Description of Bottom Portion of Prior Art Fluid Actuator

FIG. 3 is an isometric view of the bottom portion of the complete prior art fluid actuator shown in FIG. 1 and FIG. 2. FIG. 4 is a sectional view taken along the cutting plane B-B of FIG. 3. Since the operation of a fluid actuator is symmetric, it is only necessary to examine either the top portion or bottom portion for purpose of understanding the fluid actuator's operation.

FIGS. 3 and 4

Operation of Bottom Portion of Prior Art Fluid Actuator

Fluid flowing into cylinder base connection 205 forces piston 102 to move and piston rod 101 to extend. When the piston 102 moves and piston rod 101 extends, fluid is forced out of the cylinder head connection 208. Fluid flowing into the cylinder head connection forces piston 102 to move and piston rod 101 to retract. When the piston 102 moves and piston 101 retracts, fluid is forced out of the cylinder base connection 205. The prior art fluid actuator has a fluid connection 205 in the base and another fluid inlet/outlet in the head. The piston 102 does not pass over either the base connection 205 or the head connection 208. The base connection 205 is always on the base side of the piston 102. And the head connection 208 is always on the head side of the piston 102. When the prior art fluid actuator is operating as designed, fluid does not flow from the head side of the piston 102 to the base side of the piston 102.

DETAILED DESCRIPTIONS OF EMBODIMENTS AND THEIR OPERATIONS

Except where specified, the fluid used in these circuits is incompressible with insignificant foaming characteristics, a vapour point well above expected operating temperatures, and a freezing point well below expected operating temperatures. Also, the viscosity cannot be prohibitively high; if gelling occurs, it is well below expected operating temperatures.

The previous figures describe embodiments of prior art, whereas the following figures describe embodiments of the new invention being claimed.

FIGS. 5 and 6

Description of Fluid Actuator with a Fluid Limit Valve Containing No Moving Parts FIG. 5 is an isometric view of the bottom portion of a fluid actuator with a fluid limit valve containing no moving parts. FIG. 6 is a sectional view taken along the cutting plane C-C of FIG. 5.

FIGS. 5 and 6

Operation of Fluid Actuator with a Fluid Limit Valve Containing No Moving Parts

The piston 102 can be either on the head side or base side of the base fluid limit valve outlet holes 106. The base fluid limit valve cover 117 covers the valve outlet holes 106 and provides a base fluid limit valve outlet 207. A check valve will be attached to the fluid limit valve outlet 207 as later shown in fluid circuits. The check valve prevents fluid flowing into the fluid outlet 207.

Consider the situation where the piston 102 is on the base side of the base fluid limit valve outlet holes 106 and the piston 102 is extending. Fluid is forced into the base connection 205 and a check valve prevents fluid flowing into the base fluid limit valve outlet 207. The fluid forced into the base connection 205 forces the piston 102 to extend which in turn forces fluid out of the head connection 208. The combined fluid actuator with fluid limit valve is functioning as a conventional prior art fluid actuator. Until the piston 102 extends past the base fluid limit valve outlet holes 106, it continues to function as a conventional prior art fluid actuator.

Consider the situation where the piston 102 is on the head side of the valve outlet holes 106 and the piston 102 is retracting. Fluid forced into the head connections 208 causes the piston 102 to retract. As the piston 102 retracts, fluid is forced out the base connection 205 and out the base fluid limit valve outlet 207. The combined fluid actuator with fluid limit valve is functioning as a conventional prior art fluid actuator until the piston 102 retracts past the base fluid limit valve outlet holes 106. Once the piston 102 has retracted past the valve outlet holes 106, fluid forced in the head connection 208 can freely flow through the valve outlet holes 106 and out the base fluid limit valve outlet 207. As a result, the piston 102 applies negligible force against the base end cap 103. Later circuits describe how fluid limit valves used in this manner can detect and correct for fluid loss.

FIGS. 7 and 8

Description of Fluid Actuator with an Open Fluid Limit Valve Containing Moving Parts FIG. 7 is an isometric view of the bottom portion of a fluid actuator with a closed fluid limit valve with moving parts. FIG. 8 is a sectional view taken along cutting plane D-D of FIG. 7.

FIGS. 7 and 8

Operation of Fluid Actuator with an Open Fluid Limit Valve Containing Moving Parts While the piston 102 shown in FIG. 8 has not retracted or extended sufficiently for the fluid limit poppet valve 674 to come in contact with either the head or base poppet plungers, the combined fluid actuator with fluid limit valve is functioning as a conventional prior art fluid actuator.

Consider the situation where the piston 102 is retracting. Fluid forced into the head connections 208 causes the piston 102 to retract. As the piston 102 retracts, fluid is forced out of the base connection 205. The combined fluid actuator with fluid limit valve functions as a conventional prior art fluid actuator until the piston 102 retracts sufficiently for the fluid limit poppet valve 674 to come into contact with the base poppet plunger 116. Force of the base poppet plunger 116 against the fluid limit poppet valve 674 compresses the poppet fluid limit valve return spring 673 and opens fluid limit poppet valve 674. Piston 102 can retract until it comes in contact with the base poppet plunger 116. When fluid pressure on the head side of piston 102 is greater than the base side, this fluid pressure displaces the fluid bypass head check ball 678 allowing fluid to enter the head fluid limit valve hydraulic inlet 672 of the fluid limit poppet valve 674. Fluid forced into the head fluid limit valve hydraulic inlet 672 can freely flow through the poppet fluid limit valve bypass port 225, the open fluid limit poppet valve 674, the base end cap ports 223 and finally out of the base connection 205. When piston 102 is forced to retract as a result of an external force, base cap piston stop 105 is required to restrain the piston 102 and protect against over retraction. Later circuits describe how fluid limit valves used in this manner can detect and correct for fluid loss.

Similarly consider the situation where the piston 102 is extending and assume the fluid limit poppet valve 674 is initially in contact with the base poppet plunger 116 with sufficient force to open the fluid limit poppet valve 674. When fluid pressure on the base side of piston 102 is equal or greater than the head side, return spring 229 of fluid bypass head check ball 678 holds the bypass head check ball 678 closed. As a result fluid cannot flow from the base side to the head side of the piston 102. Fluid forced into the base connection 205 causes the piston 102 to extend. As the piston 102 extends, fluid is forced out of the head connection 208. The combined fluid actuator with fluid limit valve functions as a conventional prior art fluid actuator until the piston 101 extends sufficiently for the fluid limit poppet valve 674 to come into contact with the head poppet plunger. When the force exerted by the head poppet plunger against the fluid limit poppet valve 674 is sufficient, the poppet fluid limit valve return spring 673 is compressed and fluid limit poppet valve 674 opens. The fluid limit poppet valve 674 operates in this piston 102 extension fluid limit valve as described previously for the case of piston 102 retraction fluid limit valve. Later circuits describe how fluid limit valves used in this manner can detect and correct for fluid loss.

FIGS. 9 and 10

Description of an Alternate Embodiment of Fluid Actuator with an Open Fluid Limit Valve Containing Moving Parts FIG. 9 is an isometric view of the bottom portion of a fluid actuator with a closed fluid limit valve with moving parts. FIG. 10 is a sectional view taken along cutting plane E-E of FIG. 9. The fluid limit valve outlet 207 is connected to the line to the cylinder head connection 208.

FIGS. 9 and 10

Operation of an Alternate Embodiment of Fluid Actuator with an Open Fluid Limit Valve Containing Moving Parts When piston 102 has not retracted sufficiently to come in contact with the base poppet plunger 674, and has not extended sufficiently to come into contact with the head poppet plunger, the combined fluid actuator with fluid limit valve is functioning as a conventional prior art fluid actuator.

Consider the situation where the piston 102 is retracting. Fluid forced into the head connections 208 causes the piston 102 to retract. As the piston 102 retracts, fluid is forced out of the base connection 205. The combined fluid actuator with fluid limit valve functions as a conventional prior art fluid actuator until the piston 102 retracts sufficiently to come into contact with the base poppet valve 674. The force against the base poppet valve 674 compresses the poppet fluid limit valve return spring 144 and opens fluid limit poppet valve 674. Piston 102 can retract until it comes in contact with base cap piston stop 105. Fluid forced into the head connection 208 is also forced into the fluid limit valve outlet 207. Fluid forced into the fluid limit valve outlet 207 can freely flow through the base poppet valve 674 and through the fluid limit valve out 671 and finally out of the base connection 205. When piston 102 is forced to retract as a result of an external force, base cap piston stop 105 is required to restrain the piston 102 and protect against over retraction. Later circuits describe how fluid limit valves used in this manner can detect and correct for fluid loss.

Similarly, consider the situation where the piston 102 is extending. Fluid forced into the base connections 205 causes the piston 102 to extend. As the piston 102 extends, fluid is forced out of the head connection 208. The combined fluid actuator with fluid limit valve functions as a conventional prior art fluid actuator until the piston 102 extends sufficiently to come into contact with the head poppet plunger. Force of the head poppet plunger against the head fluid limit poppet valve compresses the head poppet fluid limit valve return spring and opens the head poppet fluid limit valve. Piston 102 can extend until it comes in contact with head cap piston stop. Fluid forced into the base connection 205 is also forced into the fluid limit valve head fluid connection. Fluid forced into the fluid limit valve head fluid connection can freely flow through the head poppet fluid limit valve and through the base connection and finally out of the head connection 208. When piston 102 is forced to extend as a result of an external force, head cap piston stop is required to restrain the piston 102 and protect against over extension. Later circuits describe how fluid limit valves used in this manner can detect and correct for fluid loss.

FIGS. 11, 12*a*, 12*b*, 13*a* and 13*b*

General Description of Hydraulic Cylinder with Adjustable Mechanical Limits

Hydro pneumatic and hydraulic cylinders with adjustable mechanical limits are used in steering, load leaving, roll control and many other fluid circuits requiring fluid actuators with adjustable mechanical limits or fluid leakage detection and correction within hydraulic linkages. The hydro pneumatic, hydraulic cylinders and the associated fluid limit valves with limit sensors are shown in FIG. 11, 12*a*, 12*b*, 13*a*, 13*b*. FIG. 11 is an isometric view of the hydro pneumatic cylinders used in the load balance and roll control circuits. For simplicity the hydro pneumatic cylinder shown in FIG. 11 does not include head or base mountings. A cross section of the hydraulic cylinder with adjustable mechanical limit sensors and fluid limit valves 550, 551 is taken along the cutting plane F-F and shown in FIG. 12*a*. A cross section of the hydro pneumatic cylinder is taken along the cutting plane F-F and shown in FIG. 12*b*. In FIGS. 12*a* and 12*b*, the location of the hydraulic mechanical limit sensors and fluid limit valves 550, 551 is shown. The detail cross section of the hydraulic fluid limit valve without external fluid leak correction supply is shown in FIG. 13*a*. The detailed cross section of the hydraulic fluid limit valve with external fluid leak correction supply is shown in FIG. 13*b*.

FIGS. 11, 12*a*, 12*b*, 13*a* and 13*b*

Detail Description and Operation of Hydraulic Cylinder with Adjustable Mechanical Limits The preferred embodiments, implementing the adjustable extension limit and associated head fluid limit valve 550 and the adjustable retraction limit and associated base fluid limit valve 551 are presented. The preferred methods of adjusting the extension or retraction limits is adjusting the measured value of extension and retraction limits when the piston position is measured electrically, or piston extension when the piston activates the mechanical limit sensor at extension and retraction limits. Both electrically activated limit sensors and mechanically activated limit sensors have advantages and disadvantages.

In the first embodiment the piston position is electrically measured. In this embodiment the limit sensors are activated when the piston reaches a predetermined measured position. The measured position corresponding to the extension limit of the head limit sensor can be reprogrammed. The extension limit of the head limit sensor and the retraction limit of the base limit sensor are adjusted by reprogramming the measured positions. Limit sensors activated a programmed measured piston locations do not need to be integrated into the cylinder construction. These electrically activated limit sensors can easily be housed in a separate control box attached to the cylinder or near the cylinder. This allows conventional cylinders with integrated electrical position measurement to be used without modifications. However, the electrical limit sensors require electrical power source for the cylinder position measurements and to drive solenoids opening and closing the fluid limit valves. When using the electrical limit sensors, electric solenoids' shutoff valves are required in addition to the fluid limit valves to close the actuators fluid inlet and outlet to prevent over extension and over retraction. The additional head shutoff valve prevents fluid from leaving the cylinder head, and the cylinder's piston 102 from over extending. And the additional base shutoff valve prevents fluid from leaving the cylinder base, and the cylinder's piston 102 from over retracting. The additional cylinder head shutoff valve is closed when head fluid limit valve 550 is opened. The additional cylinder base shutoff valve is closed when the base fluid limit valve 551 is opened. Time required to close the solenoid shutoff valves prevents exact enforcement of the fluid actuator's extension and retraction limits. As a result the adjustable mechanical limits are a more favourable embodiment.

In the second embodiment the mechanical limit sensors are activated by the piston mechanically forcing the fluid limit valves to open. The mechanical limit sensors can be activated directly by the piston as show in FIG. 12*b* or indirectly by means of fluid linkage. A fluid linkage can connect an external fluid limit valve to a hydraulic limit sensor integrated into the actuator. The limit sensor is activated when the main piston 102 is a distance away from the cylinder end by a floating piston. Rather than adjusting the position of the limit sensor, the distance at which the main piston 102 is away from the cylinder end is adjusted. As shown in FIG. 12*a*, it is easy to adjust the distance the limit sensor and head fluid limit valve 550 is from the main piston 102. The mechanical limit sensor is activated by the hydraulic floating head piston 686 mechanically forcing the head fluid limit valve 550 to open. It is easy to control the distance of the hydraulic floating head piston 686 from the main piston 102 by adjusting the amount of fluid between them. Similarly it is easy to adjust the distance of the limit sensor and the base fluid limit valve 551 from the main piston 102, by adjusting the amount of hydraulic fluid between the floating base piston 688 and the main piston 102. Mechanical limit sensors and fluid valves operate independently of an external power source. The hydraulically adjustable head chamber 655 between the main piston 102 and the floating head piston 686 mechanically limits the extension of the main piston 102. The extension of the floating head piston 686 is limited by the cylinder head stops. And the minimum separation between the main piston 102 and the floating head piston 686 is controlled by the amount of incompressible fluid in the head chamber 655. As a result the minimum separation of the main piston 102 from the cylinder head stops is adjusted by the amount of fluid in the head chamber 655. When the floating head piston 686 reaches the cylinder head stops, it also activates the mechanical limit sensor which opens the head fluid limit valve 550. The open head fluid limit valve 550 allows additional fluid destined for the hydraulic base chamber 654 to bypass the fluid actuator. Additional fluid forced into the hydraulic base chamber 654 would force the floating base piston 688 to extend and consequently the main piston 102 would extend. The head fluid limit valve 550 prevents fluid forced into the base of the fluid actuator from forcing the main piston 102 to over extend. Similarly the hydraulically adjustable chamber 656 between the main piston 102 and the floating base piston 688 mechanically limits the retraction of the main piston 102. And the base fluid limit valve 551 prevents fluid forced into the hydraulic head chamber 651 of the fluid actuator from forcing the main piston 102 to over retract. Similarly the hydraulically adjustable chamber 656 of the base limit switch valve 551 prevents the hydraulic cylinder from being over retracted. The main piston 102 is mechanically prevented by the floating pistons 686 and 688 from over shooting the hydraulically adjusted extension and retraction limits.

The hydro pneumatic or hydraulic cylinder shown in FIG. 11 has an outer cylinder head shell 680 which slides over the cylinder body 689. The cylinder head shell 680 protects the integrated mechanical limit sensors and the head fluid limit valve 550. The mechanical limit sensors operate as force sensors in hydro pneumatic cylinders. The cylinder head shell can also structurally support the piston shaft 683, reducing the bending load on the piston shaft 683. The cylinder head shell 680 also protects the piston shaft 683 oil seals from dirt. The cylinder head shell 680 shown in FIG. 11 is optional, but is included because of the benefits it provides. The head gas inlet 622, the head gas or hydraulic head limit adjustment chamber inlet 621 and the base gas or hydraulic base limit adjustment chamber inlet 623 are located in the cylinder head shell 680. In FIG. 12*a* the inlets 621, 623 are head and base limit adjustment chamber inlets. In FIG. 12*b* the inlets 621, 623 are head and base gas inlets. The head hydraulic inlet 630 and the base hydraulic inlet 631 are located in the cylinder body 689. The hydro pneumatic cylinder in FIG. 12*b* does not include hydraulic limit adjustment chambers 655, 656. In the hydro pneumatic cylinder in FIG. 12*b*, gas head 652 and base 653 chambers are used in place of the hydraulic limit adjustment chambers 655, 656. The gas damping valve 665 can open between the gas pressure chambers 652 and 653. The gas damping valve 665 and gas chambers 652 and 653 can operate to damp the main piston's 102 movement. The gas pressure in the piston gas base chamber 652 of the hydro pneumatic cylinder is able to damp piston extension. And similarly, gas pressure in the piston gas base chamber 653 of the hydro pneumatic cylinder is able to damp piston retraction. As the piston 102 approaches its extension or retraction limits, the gas in the head 652 and base 653 chambers is compressed. The increasing gas pressure is able to slow down the piston 102 as it approaches the extension or retraction limits. And gas pressure of the head 652 and base 653 chambers opposes the hydraulic pressure moving the piston 102. Hydro pneumatic cylinders are not often used in applications requiring precise position control. Hydraulic fluid pressurized by means of accumulators is often used instead of directly using a compressible gas in hydro pneumatic cylinders.

Consider the hydro pneumatic fluid actuator shown in FIG. 12*b* is controlled as hydraulic cylinder. As the floating head piston 686 approaches the cylinder head stops, it applies increasing force on the head mechanical limit sensor which increasingly opens the head fluid limit valve 550. As the head fluid limit valve 550 increasingly opens, it allows a greater amount of fluid to bypass the fluid actuator. As more fluid bypasses the fluid actuator, less fluid goes to extending the main piston 102. As a result the main piston slows down as the floating head piston 686 approaches the cylinder head stops. Also, the gas pressure in the head chamber 652 counters the hydraulic fluid pressure in the head chamber 651. As a result the extension force exerted on the main piston 102 reduces as the floating head piston 686 approaches the cylinder head stops. The gas pressure within the head chamber 652 is adjustable. Increasing the gas pressure within the head chamber 652 results in the floating head piston 686 approaching the cylinder head stops with reduced force. The extension of the floating head piston 686 slows further away from the cylinder head stops. The extension of the floating head piston 686 effectively stops further away from the cylinder head stops. Similarly increasing the gas pressure within the gas base chamber 653 results in the floating base piston 688 approaching the cylinder base stops with reduced force. And the retraction of the floating base piston 688 slows and effectively stops further away from the cylinder base stops.

This arrangement is useful for load sensitive steering hydraulic circuits and similar circuits requiring reduced fluid actuator travel length at low load settings. During high speed vehicle operation, the steering load decreases and the maximum safe steering angle correspondingly decreases. A hydraulic steering circuit with this operating characteristic can be constructed utilizing the hydro pneumatic fluid actuator with adjustable gas head 652 and base 653 pressure chambers. At lower steering loads, the hydraulic pressures in head 651 and base 654 chambers can be reduced. The reduced hydraulic pressures in head 651 and base 654 chambers results in the pistons approaching the cylinder stops with reduced force and slowing and stopping further away from the cylinder stops. During low speed vehicle operation, full fluid actuator steering power needs to be available. Also, maximum manoeuvrability is required during lows speed operation and the extension and retraction limits of the fluid actuator should not be reduced. During low vehicle speed operation, the hydraulic pressure in head 651 and base 654 chambers is greater than the gas pressures in the fully compressed gas head 652 and base 653 pressure chambers. In this situation, the head 652 and base 653 gas chambers will remain fully compressed and there will be no gap between the floating head 686 and base 688 pistons and the main piston 102. The main piston 102 will approach the cylinder end stops at full power and do not slow or stop before reaching the cylinder end stops. Upon the main piston 102 reaching the extension and retraction limits, the mechanical limit sensors will be activated and the fluid limit valves will allow fluid to bypass the fluid actuator. The fluid limit valves 550, 551 by allowing fluid to bypass the fluid actuator, prevent excessive force against the cylinder end stops. Also, when head 652 and base 653 gas chambers remain fully compressed, the limit sensors are only activated at the main piston 102 extension and retraction limits within the hydro pneumatic cylinder. and limit sensor activation is not gradual. When the limit sensor activation is not gradual, the fluid limit valves can detect and correct hydraulic fluid loss. At high hydraulic pressures where head 652 and base 653 gas chambers remain fully compressed, hydraulic fluid loss within an hydraulic linkage is detectable and correctable. The ability to detect and correct hydraulic fluid loss in a hydraulic steering circuit greatly reduces the reliability of the steering system. As a result the described hydro pneumatic cylinder with adjustable gas head 652 and base 653 chambers is well suited for load sensitive steering hydraulic circuits.

Alternately consider the hydro pneumatic fluid actuator shown in FIG. 12*b* is controlled as pneumatic cylinder or shock absorber. The fluid in the hydraulic base 654 and head 651 chambers is adjusted and the position of the main piston 102 is controlled by the gas chamber 652 and 653 pressures. The hydraulic head chamber 651 between the cylinder head and the floating head piston 686 mechanically limits the maximum extension of the main piston 102. The main piston 102 is operating as a pneumatic cylinder or shock absorber with its maximum extension reduced by the amount of fluid in the hydraulic head chamber 651. If there is enough hydraulic fluid in the head chamber 651 such that the floating head piston 686 does not activate the mechanical limit sensor, then the head fluid limit valve 550 plays no significant role in this operation mode. Similarly the piston 102 is operating as a pneumatic cylinder or shock absorber with its maximum retraction reduced by the amount of fluid in the hydraulic base chamber 654. Again if there is enough hydraulic fluid in the base chamber 654 such that the floating base piston 688 does not activate the mechanical limit sensor, then the base fluid limit valve 551 plays no significant role in this operation mode.

Head and base limit sensors can also be located in the main piston 102 or the head limit sensor in the floating head piston 686 and the base limit sensor in the floating base piston 688. The extension of the main piston 102 is limited by the floating head piston's 686 distance from the cylinder head. The distance the floating head piston 686 is from the cylinder head is adjusted by the amount of fluid in the hydraulic head chamber 651. When the main piston 102 is at the extension limit determined by the location of the floating head piston 686, the head limit sensor located in the piston is activated which opens the head fluid limit valve. The open head fluid limit valve allows additional compressible fluid destined for the base gas chamber 653 to bypass the hydro pneumatic fluid actuator. Additional compressible fluid forced into the base gas chamber 653 would force the main piston 102 to extend. The head fluid limit valve prevents compressible fluid forced into the base of the hydro pneumatic fluid actuator from forcing the main piston 102 to over extend. Similarly the retraction limit of the main piston 102 is controlled by the amount of fluid in the hydraulic base chamber 654. The retraction of the main piston 102 is mechanically limited by the floating base piston 688. And opening the base fluid limit valve at the main piston 102 retraction limit prevents the compressible fluid from excessively forcing the main piston 102 against its retraction limit.

The construction of the hydro pneumatic cylinder with gas chambers 652, 653 shown in FIG. 12*a* and the hydraulic cylinder with adjustable mechanical retraction and extension limits shown in FIG. 12*b* are very similar. In FIGS. 12*a* and 12*b*, a base cap with base stops 681 is attached to the cylinder body 689. The base limit switch valve 551 is mounted on the base cap 681. The base limit switch poppet plunger 674 extends past the base stops. When the hydraulic floating base piston 688 or the floating head piston 686 retracts to the base stops, it activates the base limit switch valve 551. The hollow base piston stub 685 is attached to the centre of the base cap 681. The cylinder head shell 680 slides over the cylinder body 689 as shown in FIG. 12*b*. A head cap with head stops 682 is attached to the cylinder head shell 680. The hollow piston shaft 683 is attached to the centre of the head cap 682. The hollow piston shaft 683 slides over the hollow base piston stub 685. The hydraulic head cap 684 is attached to top of the cylinder body 689. The head limit switch valve 550 is mounted on the hydraulic head cap 684. The main piston 102 corresponds to the hydraulic piston of the common prior hydraulic cylinders. The main piston 102 is attached to bottom of the hollow piston shaft 683. The hydraulic cylinder with adjustable mechanical limits is constructed with the hydraulic floating head piston 686 freely moving between the main piston 102 and the hydraulic head cap 684. The hydraulic cylinder shown in FIG. 12*a* with adjustable mechanical limits is constructed with the hydraulic floating base piston 688 freely moving between the main piston 102 and the base cap 681. The hydro pneumatic cylinder shown in FIG. 12*b* is constructed with the floating head piston 686 freely moving between the main piston 102 and the head cap 684. The hydro pneumatic cylinder is constructed with the floating base piston 688 freely moving between the main piston 102 and the base cap 681.

In FIG. 12*b*, the head gas expansion chamber 650 is filled through the piston gas inlet 622 in the head cap 682. The base hydraulic chamber 654 is filled through the hydraulic base input 631 in the base cap 681. The head hydraulic chamber 651 is filled through the hydraulic base input 630 in the base cap 681. The hydraulic base chamber 656 of the hydraulic cylinder shown in FIG. 12*a* is filled through the hydraulic base chamber inlet 623 in the piston shaft 683. The hydraulic head chamber 655 of the hydraulic cylinder shown in FIG. 12*a* is filled through the hydraulic head chamber inlet 621 in the piston shaft 683. The base gas extension chamber 653 of the hydro pneumatic cylinder shown in FIG. 12*b* is filled through the gas base inlet 623 in the head cap 682. Inlet 623 of the head cap 682 is connected to inlet 623 of the piston shaft 683. The head gas expansion chamber 652 of the hydro pneumatic cylinder shown in FIG. 12*b* is filled through the gas head inlet 621 in the head cap 682. Inlet 621 of the head cap 682 is connected to inlet 621 of the piston shaft 683.

In FIG. 12*b*, an optional piston hydraulic pump 620 is located inside a hollow piston shaft 683. The internal hydraulic piston pump 620 can be used to pump hydraulic fluid into a hydraulic accumulator. This hydraulic accumulator may be used as a hydraulic pressure source or as a fluid leak correction supply. The fluid limit valve shown in FIG. 13*b* has an inlet from the fluid leak correction supply 677. The fluid leak correction supply can compensate for fluid loss occurring in hydraulic linkage circuits without requiring hydraulic supply pump in the hydraulic linkage circuit. The internal hydraulic piston pump 620 supplying the fluid leak correction supply can eliminate any need for external pressure supply in hydraulic linkage circuits. The system is self sustaining, the internal hydraulic piston pump 620 pumps hydraulic fluid into a hydraulic accumulator used as the fluid leak correction supply. Eventual fluid loss from the hydraulic linkage circuit is provided from the fluid leak correction supply inlet of the fluid limit valves 550 and 551. The internal hydraulic piston pump 620 also damps the extension and retraction movement of the piston 102. If the optional internal piston hydraulic pump is not required, the hollow base piston stub 685 can be eliminated and a solid piston stub will be used in its place.

More details of the fluid limit valves used in FIG. 12*a*, 12*b* are shown in FIG. 13*a*, 13*b*. The base mechanical limit sensor and fluid limit valve 551 can be mounted externally on the base cap 681 as shown in FIG. 12*b*. Or the base mechanical limit sensor and fluid limit valve 551 can be mounted within the base cap 681 as shown in FIG. 12*a*. In either case the outlet 671 of the base fluid limit valve 551 is directly connected to the base hydraulic chamber 654. Hydraulic lines are directly connected to the hydraulic fluid limit valve inlets of the externally mounted base fluid limit valve 551. The internally mounted base fluid limit valve 551 requires inlets manufactured into the base cap 681, which are connected to the base fluid limit valve 551 inlets. As with the externally mounted base fluid limit valve 551, hydraulic lines are connected to the base cap 681 inlets.

The head mechanical limit sensor and fluid limit valve 550 can be mounted externally on the head cap 684 as shown in FIG. 12*b*. Or the head mechanical limit sensor and fluid limit valve 550 can be mounted within the head cap 684 as shown in FIG. 12*a*. In either case the outlet 671 of the head fluid limit valve 550 is directly connected to the head hydraulic chamber 651. In FIG. 12*b*, when an outer cylinder head shell 680 is not used and the head cap 684 is exposed, hydraulic lines are directly connected to the hydraulic fluid limit valve inlets of the externally mounted head fluid limit valve 550. The internally mounted head fluid limit valve 550 or the head cap 684 concealed by the outer cylinder head shell, requires inlets manufactured into the head cap 684. The required inlets manufactured into the head cap 684 are connected to the head fluid limit valve 550 inlets. As shown in FIG. 12*b*, when the outer cylinder head shell 680 is used, the head cap 684 inlets are connected to hydraulic lines 636 which are manufactured into the cylinder body 689. As with the exposed head fluid limit valve 550, hydraulic lines are connected to the head cap 684 inlets or cylinder body hydraulic lines 636.

In FIG. 12*a*, the main hydraulic piston 102 of the hydraulic cylinder with adjustment hydraulic chambers 655, 656 is retracted by hydraulic fluid flowing through the head hydraulic inlet 630 into the hydraulic head chamber 651. The main piston 102 of the hydraulic cylinder with adjustment hydraulic chambers 655, 656 is extended by hydraulic fluid flowing through the base hydraulic inlet 631 into the hydraulic base chamber 654.

To set the retraction limit of the hydraulic cylinder with a hydraulic adjustable base chamber 656, the main piston 102 is first retracted or extended to the desired location of the retraction limit. The main piston 102 is extended by forcing fluid into the hydraulic base chamber 654. The main piston 102 is retracted by forcing fluid into the hydraulic head chamber 651. Once the main piston 102 is set at the desired location of the retraction limit, the fluid in the hydraulic adjustable head chamber 655 and hydraulic head chamber 651 is fixed as required to prevent the main piston 102 from moving.

The required amount of hydraulic fluid in the hydraulic base chamber 656 of the hydraulic or hydro pneumatic cylinder can now be set. Hydraulic fluid is forced through the hydraulic base chamber inlet 623 into the hydraulic base chamber 656, retracting the hydraulic floating base piston 688 until it is prevented from further retracting by the cylinder base stops. The amount of hydraulic fluid forced into the hydraulic base chamber 656 is the required amount of hydraulic fluid between the main piston 102 and the floating base piston 688 for the desired retraction limit. The amount of hydraulic fluid in hydraulic base chamber 656 of the hydraulic or hydro pneumatic cylinder has been set according to the desired retraction limit. The correct amount of hydraulic fluid in the hydraulic base chamber 656 is indicated by the floating base piston 688 activating the base mechanical limit sensor. At this point the operator observes that hydraulic fluid flowing into the hydraulic base chamber 656 has ceased. Based on this observation, the operator closes off the hydraulic base chamber inlet 623. Closing off the hydraulic base chamber inlet 623 fixes the amount of fluid in the hydraulic base chamber 656 and fixes the retraction limit as desired. Alternately the retraction limit can be automatically set by utilizing the base mechanical limit sensor with an optional electric switch. Automatically setting the retraction limit does not require an operator to observe the hydraulic flow into the hydraulic base chamber 656 and close off the hydraulic base chamber inlet 623. When the floating base piston 688 is at the cylinder base stops, the base fluid limit valve poppet plunger 674 is compressed. The action of compressing the base fluid limit valve poppet plunger activates the base mechanical limit sensor. The activated base mechanical limit sensor changes the state of the optional base electrical switch from normal closed to open or from normal open to closed. During the procedure of setting the retraction limit, the base electrical switch changing from its normal state and signals a shutoff valve to close off the hydraulic base chamber inlet 623. When not setting the retraction limit, changing the state of the optional electrical switch has no effect on the hydraulic base chamber inlet 623 shutoff valve. The optional base electrical switch will indicate to the operator when the floating base piston is fully retracted. When setting the retraction limit, the operator can overcome a failure of the shutoff valve to close off the hydraulic base chamber inlet 623. This is done by manually closing off the hydraulic base chamber inlet 623 when indicated by the base electrical switch. When not setting the retraction limit, the base electrical switch indicator also informs the operator that the hydraulic cylinder is at its retraction limit. This is useful as it indicates when hydraulic fluid leakage has occurred in a hydraulic linkage circuit connecting hydraulic cylinders together. Hydraulic fluid leakage in a hydraulic linkage circuit is indicated by the connected hydraulic cylinders not reaching their corresponding retraction and extension limits simultaneously. It also indicates to the operator it is pointless to attempt to further retract the hydraulic cylinder currently at its retraction limit. The extension limit of the hydraulic or hydro pneumatic cylinder is set by means of a similar procedure. In the event of a slow hydraulic leakage effecting the amount of fluid in the hydraulic adjustment chambers 655, 656, the extension and retraction limits can be reset by repeating the procedures.

Furthermore, the fluid actuator retraction limit can be dynamically controlled by continuously adjusting the amount of hydraulic fluid in the hydraulic base chamber 656. The fluid actuator may be hydraulic and hydro pneumatic cylinder or hydraulic and hydro pneumatic rotary actuator. Control of the fluid actuators' retraction and extension limits is very useful for imposing limits on the 3D movement of a mechanical component. When a fluid actuator's retraction and extension limits depends on the extension length and/or rotation angle of other fluid actuators. dynamically controlled mechanical extension and retraction limits are required.

The hydraulic base 656 and head 655 chambers can be dynamically controlled by hydraulically linking them to the extension or rotation of other fluid actuators. The complexity of the hydraulic circuits required to hydraulically link the hydraulic base 656 and head 655 chambers increases exponentially with the number of other fluid actuators on which the fluid actuator's extension and retraction limits depend. Controlling the hydraulic fluid in the base 656 or head 655 chambers by means of hydraulic linkages is preferred, when the fluid actuator's extension and retraction limits each only depend on a very small number of other fluid actuators. When the extension length and/or rotation angle of several fluid actuators affect the fluid actuator's required extension and retraction limits, it is preferred the position of the floating pistons 688, 686 is measured. A feed back based controller using the measure position of the floating pistons 688, 686 opens and closes valves accordingly to insure the correct measured displacement of the floating pistons 688, 686.

The main piston 102 of the hydro pneumatic cylinder shown in FIG. 12*b* is retracted by either hydraulic fluid flowing through the head inlet 630 into the head chamber 651 or pressurized fluid/gas forced through the head inlet 621 into the head chamber 652. The main piston 102 of the hydro pneumatic cylinder is extended by either hydraulic fluid flowing through the base inlet 631 into the base chamber 654 or pressurized fluid/gas forced through the base inlet 623 into the base chamber 653.

In FIG. 12*b*, a gas damping valve or fluid limit valve 665 may be built into the main piston 102. The gas damping valve 665 between the gas head chamber 652 and the gas base chamber 653 may be opened and closed to control the damping frequency and damping stiffness. The pressure in the gas head chamber 652 required to open the gas damping valve 665 allowing flow from the gas head chamber 652 to the gas base chamber 653, may be controlled by a reference pressure. The reference pressure regulating the flow from the gas head chamber 652 to the gas base chamber 653 is supplied via an inlet in the head cap 682. The pressure in the gas base chamber 653 required to open the gas damping valve 665 allowing flow from the gas base chamber 653 to the gas head chamber 652, may be controlled by a reference pressure. The reference pressure regulating the flow from the gas base chamber 653 to the gas head chamber 652 is supplied via an inlet in the head cap 682. The damping stiffness of the hydro pneumatic cylinder is determined by the reference pressures controlling the flow between the gas head chamber 652 and the gas base chamber 653. The damping frequency is indirectly controlled by the volume of pressurized fluid flowing through the gas damping valve 665.

The hydro pneumatic cylinder controlled in this manner is operated as previously described. The hydraulic head 651 and base 654 chambers can be used to adjust the main piston 102 extension and retraction limits. The head 550 and base 551 mechanical sensors and fluid limit valves are not usable when attached to the head 684 and base 681 end caps as shown in FIG. 12*b*. Head and base mechanical sensors and fluid limit valves can be located in the piston as shown in FIG. 8. The retraction limit of the main piston 102 is controlled by the amount of fluid in the hydraulic base chamber 654. The retraction of the main piston 102 is mechanically limited by the floating base piston 688. And opening the base fluid limit valve at the main piston 102 retraction limit prevents the compressible fluid from excessively forcing the main piston 102 against its retraction limit. Similarly the extension limit of the main piston 102 is controlled and is prevented from exerting excessive force against its extension limit. Also, the described hydro pneumatic cylinder with adjustable gas head 652 and base 653 chambers is well suited for load sensitive hydraulic circuits.

Alternately main piston 102 of the hydro pneumatic cylinder can be retracted by either pressurized fluid/gas forced through the head inlet 630 into the head chamber 651 or hydraulic fluid flowing through the head inlet 621 into the head chamber 652. The main piston 102 of the hydro pneumatic cylinder can be alternately extended by either pressurized fluid/gas forced through the base inlet 631 into the base chamber 654 or hydraulic fluid flowing through the base inlet 623 into the base chamber 653. An external gas damping valve can be located between external fluid lines connecting the head chamber 651 and base chamber 654. The external gas damping valve between the gas head chamber 651 and the gas base chamber 654 may be opened and closed to control the damping frequency and damping stiffness. The pressure in the gas head chamber 651 required to open the external gas damping valve allowing flow from the gas head chamber 651 to the gas base chamber 654, may be controlled by a reference pressure. The reference pressure regulating the flow from the gas head chamber 651 to the gas base chamber 654 is connected to the external gas damping valve. The pressure in the gas base chamber 654 required to open the external gas damping valve allowing flow from the gas base chamber 654 to the gas head chamber 651, may be controlled by a reference pressure. The reference pressure regulating the flow from the gas base chamber 654 to the gas head chamber 651 is connected to the external gas damping valve. The damping stiffness of the hydro pneumatic cylinder is determined by the reference pressures controlling the flow between the gas head chamber 651 and the gas base chamber 654. The damping frequency is indirectly controlled by the volume of pressurized fluid flowing through the external gas damping valve.

Consider the situation where the main piston 102 of the hydro pneumatic cylinder is extended and retracted by pressurized fluid/gas forced into the head 651 and base 654 chambers. When operating as described, the hydro pneumatic fluid actuator acts as pneumatic cylinder or shock absorber with adjustable extension and retraction limits. The base 551 and head 550 mechanical limit sensors and fluid limit valves are integrated into the hydro pneumatic cylinder as shown in FIG. 12*b*. The hydraulic fluid in the base 653 and head 652 chambers is adjusted and the position of the main piston 102 is controlled by the gas base 654 and head 651 chamber pressures. The hydraulic fluid in the head chamber 652 between the main piston 102 and the floating head piston 686, mechanically limits the maximum extension of the main piston 102. The main piston 102 is operating as a pneumatic cylinder or shock absorber with its maximum extension reduced by the amount of hydraulic fluid in the head chamber 652. The extension of the main piston 102 is limited by the floating head piston's 686 distance from the main piston 102. The distance the floating head piston 686 is from the main piston 102 is adjusted by the amount of hydraulic fluid in the head chamber 652. When the main piston 102 is at the extension limit. The floating head piston 686 activates the head limit sensor located in the cylinder head cap 684 which opens the head fluid limit valve 550. The open head fluid limit valve 550 allows additional compressible fluid destined for base gas chamber 654 to bypass the hydro pneumatic fluid actuator. Additional compressible fluid forced into the base gas chamber 654 would force the main piston 102 to extend. The head fluid limit valve 550 prevents compressible fluid forced into the base of the hydro pneumatic fluid actuator from forcing the main piston 102 to over extend. Similarly the retraction limit of the main piston 102 is controlled by the amount of hydraulic fluid in the base chamber 653. The retraction of the main piston 102 is mechanically limited by the floating base piston 688, and the base fluid limit valve 551 prevents the compressible fluid from excessively forcing the main piston 102 to over retract.

FIGS. 13*a* and 13*b*

Detail Description and Operation of Fluid Limit Valves

The detail cross-section of the fluid limit valves are shown in FIG. 13*a* and FIG. 13*b*. The fluid limit valve body 676 of the fluid limit valve shown in FIG. 13*a* has one hydraulic inlet 672 and one hydraulic outlet 671. The fluid limit valve body 676 of the fluid limit valve with external fluid leak correction supply shown in FIG. 13*b* has two hydraulic inlets 672, 677 and one hydraulic outlet 671. The poppet plunger 674 extends from the limit switch body 676 out of the outlet 671. A return spring 673 is forcing the poppet plunger 674 to close until the piston mechanically forces the poppet plunger 674 into the fluid limit valve body 676. The hydraulic pressure at the hydraulic outlet 671 has relatively little effect on the poppet plunger 674 because of the small poppet plunger 674 area. When poppet plunger 674 is closed, it is seated against the fluid limit valve body 676 and fluid cannot flow from the fluid limit valve fluid cavity 679 out of the hydraulic outlet 671.

The check valve plunger 678 is located inside the fluid limit valve body 676 at the inlet 672. A return spring 673 is forcing the check valve plunger 678 to close until there is sufficient hydraulic pressure to compress the return spring 673 and force the check valve plunger 678 deeper into the fluid limit valve body 676 away from the inlet 672. The check valve plunger 678 is only opened when the hydraulic pressure at inlet 672 is sufficiently greater than the fluid limit valve cavity 679 pressure to overcome the return spring 673 force. The hydraulic pressure at the hydraulic inlet 672 has a large effect on the check valve plunger 678 because of the large check valve plunger 678 area. When the check valve plunger 678 is closed, it is seated against the limit switch body 676 and fluid cannot flow from the fluid limit valve fluid cavity 679 out of the hydraulic inlet 672.

The fluid limit valve with external fluid leak correction supply shown in FIG. 13*b* has an additional hydraulic inlet 677. The check valve plunger 678 is located inside the fluid limit valve body 676 at the inlet 677. A return spring 673 is forcing the check valve plunger 678 to close until there is sufficient hydraulic pressure to compress the return spring 673 and force the check valve plunger 678 deeper into the fluid limit valve body 676 away from the inlet 677. The check valve plunger 678 is only opened when the hydraulic pressure at inlet 677 is sufficiently greater than the fluid limit valve cavity 679 pressure to overcome the return spring 673 force. The hydraulic pressure at the hydraulic inlet 677 has a large effect on the check valve plunger 678 because of the large check valve plunger 678 area. When the check valve plunger 678 is closed, it is seated against the fluid limit valve body 676 and fluid cannot flow from the fluid limit valve cavity 679 out of the hydraulic inlet 677.

FIG. 14

Description of Basic Cross Connect and Leak Compensation Illustrating The Fluid Limit Valve with Moving Parts Fluid limit valves are used to compensate and correct for fluid loss in the fluid circuit. There are coordinated piston displacements of equal magnitude but opposite direction in each cylinder because of the cross connect. Fluid check valves establish unidirectional fluid flow. In addition, fluid limit valves serve several purposes.

FIG. 14

Operation of Basic Cross Connect and Leak Compensation illustrating the Fluid Limit valve with moving parts The operation and functions of the fluid limit valves with moving parts are as follows:

First, fluid limit valves 500 and 510 can be in either a connect state or disconnect state. In connect state, fluid flows through the valves. In disconnect state, fluid flowing through the valves is prevented.

Second, fluid limit valves 500 and 510 are used to compensate and correct for fluid loss in the fluid circuit. Fluid loss occurs when there is a leak in the fluid circuit. Normally, as the piston of fluid actuator 320 extends, the piston of fluid actuator 322 correspondingly retracts by the same displacement volume. Also, as the piston of fluid actuator 320 retracts, the piston of fluid actuator 322 correspondingly extends by the same displacement volume. However, over time as there is fluid leakage in the fluid circuit, the piston displacement volumes will not be the same without leak compensation.

Third, a fluid limit valve at the cylinder head connection prevents the piston from overextending and pushing too hard against the cylinder ends.

Fourth, a fluid limit valve at the cylinder base connection prevents the piston from retracting too hard against the cylinder ends. This extension/retraction limiting reduces wear and tear, thus reducing the need for maintenance and increasing the lifetime of the fluid actuator. The operation of fluid limit valves is described below.

Fluid is drawn from the fluid reservoir by high-pressure main fluid pump 310 through line 901. Then the fluid is pumped through fluid control valve 410 by way of line 930. There are two possible states for fluid control valve 410: crossover state 411 and straight-through state 412.

Crossover state 411 causes the piston of fluid actuator 320 to extend and the piston of fluid actuator 322 to retract. Straight-through state 412 causes the piston of fluid actuator 320 to retract and the piston of fluid actuator 322 to extend. The process by which this occurs is described below.

In crossover state 411, fluid from line 930 goes to line 911 through fluid control valve 410 and then to the cylinder head connection of fluid actuator 322 and to fluid limit valves 510. The fluid entering the cylinder head connection of fluid actuator 322 forces its piston to retract. There are two possible cases here resulting in two different states for fluid limit valve 510.

In the first case, the piston of fluid actuator 322 does not retract sufficiently to apply force to mechanical activator 341 and hence does not activate fluid limit valve 510. Therefore, fluid limit valve 510 is in disconnect state 511 and fluid cannot flow between line 911 and line 915. The retraction of the piston into the cylinder of fluid actuator 322 displaces fluid from the cylinder base connection of fluid actuator 322 into line 915. Fluid flows from line 915 into fluid actuator 320.

In the second case, the piston 322 retracts sufficiently to apply force to mechanical activator 341 and hence activates fluid limit valve 510. Therefore, fluid limit valve 510 is in connect state 512. Fluid from line 911 flows through the fluid limit valve 510 and through fluid check valve 331 into line 915. Fluid check valve 331 prevents fluid from flowing from line 915 to line 911; it only allows fluid to flow from line 911 to line 915. fluid limit valve 510 is in connect state 512 so fluid flows through it into line 915 and the cylinder base connections of fluid actuators 320 and 322. Fluid flowing into the cylinder base connection of fluid actuator 322 counteracts the piston retraction, thus preventing the piston from retracting too hard against the cylinder ends. If piston of fluid actuator 322 is under significant external extension force, the reduced retraction force applied by the fluid bypassing the piston may allow the piston to extend until it does not activate fluid limit 510. After reverting to the first case, the piston of fluid actuator 322 will retract until it again activates the fluid limit valve 510. This covers the two states for fluid limit valve 510.

In both cases fluid flows from line 915 into the cylinder base connection of fluid actuator 320 where it forces the piston to extend. The piston extension forces fluid out of the cylinder head connection of fluid actuator 320 into line 910. Fluid flows from line 910 to line 903 through fluid control valve 410 in crossover state 411. Line 903 returns the fluid to the fluid reservoir.

In crossover state 411, fluid loss can be seen to have occurred when the piston of fluid actuator 322 is fully retracted and the piston of fluid actuator 320 is not fully extended. In this situation the piston of fluid actuator 322 is fully retracted, and no more fluid can be forced out of its cylinder base connection. However, the piston of fluid actuator 320 has not fully extended, therefore fluid loss has occurred. The amount of required fluid flowing through the fluid limit valve 510, bypassing the fluid actuator 322 and extending fluid actuator 320, is equal to the fluid loss that has occurred. Hence the circuit in the crossover state 411 with fluid limit valve 510 can both compensate and measure fluid loss.

In straight-through state 412, fluid from line 930 goes to line 910 through fluid control valve 410 and then to the cylinder head connection of fluid actuator 320 and to fluid limit valves 500. The fluid entering the cylinder head connection of fluid actuator 320 forces its piston to retract. There are two possible cases here resulting in two different states for fluid limit valve 500.

In the first case, the piston of fluid actuator 320 does not retract sufficiently to apply force to mechanical limit sensor 340 and hence does not activate fluid limit valve 500. Therefore, fluid limit valve 500 is in disconnect state 501 and fluid cannot flow between line 910 and line 915. The retraction of the piston into the cylinder of fluid actuator 320 displaces fluid from the cylinder base connection of fluid actuator 320 into line 915. Fluid flows from line 915 into fluid actuator 322.

In the second case, the piston of the fluid actuator 320 retracts sufficiently to apply force to mechanical limit sensor 340 and hence activates fluid limit valve 500. Therefore, fluid limit valve 500 is in connect state 502. Fluid from line 910 flows through the fluid limit valve 500 and through fluid check valve 330 into line 915. Fluid check valve 330 prevents fluid from flowing from line 915 to line 910; it only allows fluid to flow from line 910 to line 915. fluid limit valve 500 is in connect state 502, so fluid flows through it into line 915 and the cylinder base connections of fluid actuators 320 and 322. Fluid flow into the cylinder base connection of fluid actuator 320 counteracts the piston retraction, thus preventing the piston from retracting too hard against the cylinder ends. If piston of fluid actuator 320 is under significant external extension force, the reduced retraction force applied by the fluid bypassing the piston may allow the piston to extend until it does not activate fluid limit 500. After reverting to the first case, the piston of fluid actuator 320 will retract until it again activates the fluid limit valve 500. This covers the two states for fluid limit valve 500.

In both cases, fluid flows from line 915 into the cylinder base connection of fluid actuator 322 where it forces the piston to extend. The piston extension forces fluid out of the cylinder head connection of fluid actuator 322 into line 911. Fluid flows from line 911 to line 903 through fluid control valve 410 in straight-through state 412. Line 903 returns the fluid to the fluid reservoir.

In straight-through state 412, fluid loss can be seen to have occurred when the piston of fluid actuator 320 is fully retracted and the piston of fluid actuator 322 is not fully extended. In this situation, the piston of fluid actuator 320 is fully retracted and no more fluid can be forced out of its cylinder base connection. However, the piston of fluid actuator 322 has not fully extended, therefore fluid loss has occurred. The amount of required fluid flowing through the fluid limit valve 500, bypassing fluid actuator 320 and extending fluid actuator 322, is equal to the fluid loss that has occurred. Hence, the circuit in the straight-through state 412 with fluid limit valve 500 can both compensate and measure fluid loss.

FIG. 15

Description of Basic Cross Connect and Leak Compensation Illustrating The Fluid Limit Valve with No Moving Parts This diagram is similar to FIG. 14, but the fluid limit valves have no moving parts. This fluid limit valve has no disconnect state. Instead, the outlet of the fluid limit valve is connected to either the fluid on the base side of the piston or the fluid on the head side of the piston. If the fluid limit valve is integrated into the base of the cylinder actuator, the situation when the fluid limit valve outlet is connected to the base we will call self-connect, and the situation when the fluid limit valve outlet is connected to the head we will call through-connect. Similarly, if the fluid limit valve is integrated into the head of the cylinder actuator, the situation when the fluid limit valve outlet is connected to the head we will call self-connect, and the situation when the fluid limit valve outlet is connected to the base we will call through-connect. There are coordinated piston displacements of equal magnitude but opposite direction in each cylinder because of the cross connect. Fluid check valves establish unidirectional fluid flow. In addition, fluid limit valves serve several purposes.

FIG. 15

Operation of Basic Cross Connect and Leak Compensation Illustrating The Fluid Limit Valve with No Moving Parts The operation and function of the fluid limit valves with no moving parts are as follows:

First, fluid limit valves can be in either self-connect state or through-connect state. When the fluid limit valve is integrated into the base of the cylinder actuator, the outlet of the fluid limit valve is normally connected by a fluid line to the base outlet of the cylinder actuator. Similarly when the fluid limit valve is integrated into the head of the cylinder actuator, the outlet of the fluid limit valve is normally connected by a fluid line to the head outlet of the cylinder actuator. In this configuration, during the self-connect state the fluid limit valve does not allow fluid to flow between the head and the base of the cylinder actuator. In the through-connect state the fluid limit valve does allow fluid to freely flow between the head and the base of the cylinder actuator.

Second, fluid limit valves are used to compensate and correct for fluid loss in the fluid circuit. Fluid loss occurs when there is a leak in the fluid circuit. Normally, as the piston of fluid actuator 320 extends, the piston of fluid actuator 322 correspondingly retracts by the same displacement volume. Also, as the piston of fluid actuator 320 retracts, the piston of fluid actuator 322 correspondingly extends by the same displacement volume. However, over time as there is fluid leakage in the fluid circuit, the piston displacement volumes will not be the same without leak compensation.

Third, a fluid limit valve at the cylinder head connection prevents the piston from over-extending and pushing too hard against the cylinder end.

Fourth, a fluid limit valve at the cylinder base connection prevents the piston from retracting too hard against the cylinder ends. This extension/retraction limiting reduces wear and tear, thus reducing the need for maintenance and increasing the lifetime of the fluid actuator. The operation of fluid limit valves is described below.

Fluid is drawn from the fluid reservoir by high-pressure main fluid pump 310 through line 901. Then the fluid is pumped through fluid control valve 410 by way of line 930. There are two possible states for fluid control valve 410: crossover state 411 and straight-through state 412.

Crossover state 411 causes the piston of fluid actuator 320 to extend and the piston of fluid actuator 322 to retract. Straight-through state 412 causes the piston of fluid actuator 320 to retract and the piston of fluid actuator 322 to extend. The process by which this occurs is described below.

In crossover state 411, fluid from line 930 goes to line 911 through fluid control valve 410 and then to the cylinder head connection of fluid actuator 322 and to fluid limit valves 560. The fluid entering the cylinder head connection of fluid actuator 322 forces its piston to retract. There are two possible cases here resulting in two different states for fluid limit valve 560.

In the first case, the piston of fluid actuator 322 does not retract sufficiently to activate fluid limit valve 560. Therefore, fluid limit valve 560 is in self-connect state 561 and fluid cannot flow between line 911 and line 915. The retraction of the piston into the cylinder of fluid actuator 322 displaces fluid from the cylinder base connection of fluid actuator 322 into line 915.

In the second case, the piston retracts sufficiently to activate fluid limit valve 560. Therefore, fluid limit valve 560 is in through-connect state 562. Fluid from line 911 flows through the fluid limit valve 560 and through fluid check valve 331 into line 915. Fluid check valve 331 prevents fluid from flowing from line 915 to line 911; it only allows fluid to flow from line 911 to line 915. Fluid limit valve 560 is in through-connect state 562 so fluid flows through it into line 915 and the cylinder base connections of fluid actuators 320 and 322. Fluid flow into the cylinder base connection of fluid actuator 322 counteracts the piston retraction, thus preventing the piston from retracting too hard against the cylinder ends. If piston of fluid actuator 322 is under significant external extension force, the reduced retraction force applied by the fluid bypassing the piston may allow the piston to extend until it does not activate fluid limit valve 560. After reverting to the first case, the piston of fluid actuator 322 will retract until it again activates the fluid limit valve 560. This covers the two states for fluid limit valve 560.

In both cases, fluid flows from line 915 into the cylinder base connection of fluid actuator 320 where it forces the piston to extend. The piston extension forces fluid out of the cylinder head connection of fluid actuator 320 into line 910. Fluid flows from line 910 to line 903 through fluid control valve 410 in crossover state 411. Line 903 returns the fluid to the fluid reservoir.

In crossover state 411, fluid loss can be seen to have occurred when the piston of fluid actuator 322 is fully retracted and the piston of fluid actuator 320 is not fully extended. In this situation, because the piston of fluid actuator 322 is fully retracted, no more fluid can be forced out of its cylinder base connection. However, the piston of fluid actuator 320 has not fully extended, therefore fluid loss has occurred. The amount of required fluid flowing through the fluid limit valve 560, bypassing fluid actuator 322 and extending fluid actuator 320, is equal to the fluid loss that has occurred. Hence, the circuit in the crossover state 411 with fluid limit valve 560 can both compensate and measure fluid loss.

In straight-through state 412, fluid from line 930 goes to line 910 through fluid control valve 410 and then to the cylinder head connection of fluid actuator 320 and to fluid limit valves 540. The fluid entering the cylinder head connection of fluid actuator 320 forces its piston to retract. There are two possible cases here resulting in two different states for fluid limit valve 540.

In the first case, the piston of fluid actuator 320 does not retract sufficiently to activate fluid limit valve 540. Therefore, fluid limit valve 540 is in self-connect state 541 and fluid cannot flow between line 910 and line 915. The retraction of the piston into the cylinder of fluid actuator 320 displaces fluid from the cylinder base connection of fluid actuator 320 into line 915.

In the second case, the piston retracts sufficiently to apply force to activate fluid limit valve 540. Therefore, fluid limit valve 540 is in through-connect state 542. Fluid from line 910 flows through the fluid limit valve 540 and through fluid check valve 330 into line 915. Fluid check valve 330 prevents fluid from flowing from line 915 to line 910; it only allows fluid to flow from line 910 to line 915. Fluid limit valve 540 is in through-connect state 542 so fluid flows through it into line 915 and the cylinder base connections of fluid actuators 320 and 322. Fluid flow into the cylinder base connection of fluid actuator 320 counteracts the piston retraction, thus preventing the piston from retracting too hard against the cylinder ends. If piston of fluid actuator 320 is under significant external extension force, the reduced retraction force applied by the fluid bypassing the piston may allow the piston to extend until it does not activate fluid limit 540. After reverting to the first case, the piston of fluid actuator 320 will retract until it again activates the fluid limit valve 540. This covers the two states for fluid limit valve 540.

In both cases, fluid flows from line 915 into the cylinder base connection of fluid actuator 322 where it forces the piston to extend. The piston extension forces fluid out of the cylinder head connection of fluid actuator 322 into line 911. Fluid flows from line 911 to line 903 through fluid control valve 410 in straight-through state 412. Line 903 returns the fluid to the fluid reservoir.

In straight-through state 412, fluid loss can be seen to have occurred when the piston of fluid actuator 320 is fully retracted and the piston of fluid actuator 322 is not fully extended. In this situation, the piston of fluid actuator 320 is fully retracted and no more fluid can be forced out of its cylinder base connection. However, the piston of fluid actuator 322 has not fully extended, therefore fluid loss has occurred. The amount of required fluid flowing through the fluid limit valve 540, bypassing fluid actuator 320 and extending fluid actuator 322, is equal to the fluid loss that has occurred. Hence, the circuit in the straight-through state 412 with fluid limit valve 540 can both compensate and measure fluid loss.

FIG. 16

General Description of Fluid Actuator with External Mechanical Limit Stops

Adjustable mechanical limit stops can be integrated into hydro pneumatic and hydraulic cylinders as shown in FIG. 11, 12*a*, 12*b*, 13*a*, 13*b* and previously described. However, adjustable mechanical limit stops need not be integrated into hydro pneumatic and hydraulic cylinders. FIG. 16 shows prior art fluid actuators utilizing external mechanical limit stops with associated limit sensors and fluid limit valves 551. A prior art fluid actuator could be a hydraulic cylinder, hydraulic rotary actuator, hydro pneumatic cylinder, hydro pneumatic rotary actuator, pneumatic cylinder or pneumatic rotary actuator. For illustration, a prior art hydraulic cylinder 710 was chosen as an example prior art fluid actuator. In apparatus shown in FIG. 16, the articulation of two separation pivots 701 is coordinated. Many applications in industry require coordination of separated pivots, such as steering, self levelling to name a few. Two prior art hydraulic cylinders 710 are used to articulate each separated pivot 701. The two prior art hydraulic cylinders are linked together in a hydraulic circuit. The components shown in FIG. 16 are hydraulically linked by a basic fluid linkage utilizing the fluid limit valve with moving parts as shown in FIG. 14. The detail cross section of the prior art hydraulic cylinders 710 is shown in FIG. 2. The external adjustable mechanical limit stops with associated limit sensors and fluid limit valves 551 are same as the integrated adjustable mechanical limit stops with associated limit sensors and fluid limit valves 551 used by the hydraulic and hydro pneumatic cylinders as shown in 12*a*, 12*b*. The external adjustable mechanical limit stops with associated limit sensors and fluid limit valves 551 lack a main piston 102 required to convert fluid pressure into an applied mechanical force. Externally the adjustable mechanical limit stop with associated limit sensors and fluid limit valves 551 appears as a smaller version of the hydraulic and hydro pneumatic cylinders as shown FIG. 11. In FIG. 16, the limit sensors and fluid limit valve 551 is shown as block diagram within the cross-section of the adjustable mechanical limit stop. A detail cross section of the fluid limit valve 551 is shown in FIG. 13*a*.

FIG. 16

Detail Description and Operation of Fluid Actuator with External Mechanical Limit Stops The side frames 706 are connected to the pivot connecting frame 707 by separated pivot joints 701. Two external adjustable mechanical limit stops with associated limit sensors and fluid limit valves 551 are mounted on both ends of one side frame 706. The adjustable mechanical limit stops with associated limit sensors and fluid limit valves 551 are mounted with the mechanical limit pistons facing the other side frame 706. Hydraulic cylinders 710 are mounted between the pivot connecting frame 707 and each side frame 706 as shown in FIG. 16. Each hydraulic cylinder 710 is mounted to the pivot connecting frame 707 and side frame 706 by a hydraulic cylinder mounting joint 700. As illustrated by FIG. 16, the hydraulic cylinder mounting joint 700 and pivot joints 701 allows the hydraulic cylinders 710 side frame 706 and pivot connecting frame 707 to move within a plane. The side frame 706 with mounted mechanical limit stops with associated limit sensors and fluid limit valves 551 is fixed. The other side frame 706 is movable under the control of the hydraulic cylinders 710. One hydraulic cylinder 710 is mounted between the upper half of the fixed side frame 706 and the pivot connecting frame 707. The other hydraulic cylinder 710 is symmetrically mounted between the lower half of the movable side frame 706 and the pivot connecting frame 707. The hydraulic circuit shown in FIG. 14 is used to connect the hydraulic cylinders and external adjustable mechanical limit stops with associated limit sensors and fluid limit valves 551 together. The hydraulic cylinders 710 shown in FIG. 16 are the fluid actuators 320 and 322 labelled in the hydraulic circuit shown in FIG. 14. Also, the fluid limit valves 551 shown in FIG. 16 are the fluid limit valves 500 and 510 activated at the retraction limits of the fluid actuators 320 and 322 as labelled in hydraulic circuit shown in FIG. 14. The mechanical limit sensor of a fluid limit valve 551 in FIG. 16 is activated by the floating base piston retracting and compressing the poppet plunger 674 of the fluid limit valve. This is mechanical limit sensor in FIG. 16 is the same mechanical limit sensors 340 and 341 shown in the hydraulic circuit of FIG. 14. In FIG. 16, the upper external adjustable mechanical limit stop associated with the upper hydraulic cylinder 710 is in the same manner by which the fluid limit valve 500 is associated with the fluid actuator 320 in FIG. 14. The lower external adjustable mechanical limit stop associated with lower hydraulic cylinder 710 is in the same manner by which the fluid limit valve 510 is associated with the fluid actuator 322 in FIG. 14.

The external adjustable mechanical limit stops with associated limit sensors and fluid limit valves 551 are constructed as follows. The fluid limit valve 551 is located in the base portion of the adjustable mechanical limit stop. The fluid inlet 672 and outlet 672 of the fluid limit valve 551 connect to a corresponding fluid inlet and outlet of the adjustable mechanical limit stop. The fluid limit valve 551 located within the adjustable limit stop is activated by the floating base piston 688 retracting and compressing poppet plunger 674. The floating base piston 688 is prevented from overextending and damaging the fluid limit valve 551 by base stops built into the adjustable mechanical limit stop body 702. The mechanical limit piston 720 extends out of the head of the adjustable mechanical limit stop body 702. The separation between floating piston 688 and the mechanical limit piston 720 is determined by the amount of hydraulic fluid in the base chamber 656. The mechanical limit stop is adjusted by adjusting the separation between the floating piston 688 and the mechanical limit piston 720. The separation 705 between the floating piston and the limit piston is adjusted and the amount of hydraulic fluid in the base chamber 656 is set following mechanical limit stop adjustment procedure. The same procedure described for setting the adjustable mechanical limit stop integrated into a hydro pneumatic or hydraulic cylinder is not repeated here. The floating base piston 688 is contained between the base stops integrated into the mechanical limit stop body and extension stops. The extension stops prevents the floating base piston 688 from crossing over to the wrong side of the base chamber 656 fluid inlet. The mechanical limit piston 720 is constructed with shoulder to ensure that it does not block off the base chamber 656 fluid inlet. The head chamber 721 between the mechanical limit piston 720 and the mechanical limit head is vented by means of vent 722. The mechanical limit stop is similar to a single acting hydraulic cylinder with fluid limit valve 551 attached. Alternately the fluid limit valve 551 could be mounted externally on a prior art single acting hydraulic cylinder. The hydraulic chamber of the single acting hydraulic cylinder is equivalent to the base chamber 656 of the external adjustable mechanical limit stop. The amount of hydraulic fluid in the chamber of the single acting hydraulic cylinder is again set according to the same procedure used with the hydro pneumatic and hydraulic cylinders with adjustable mechanical limit stops. Compressing the single acting hydraulic cylinder will also compress the externally mounted fluid limit valve. Compressing the single acting hydraulic cylinder with sufficient force will activate the mechanical limit sensor by compressing the poppet valve plunger of the fluid limit valve 551.

The hydraulic cylinders 710 in FIG. 16 are connected as the fluid actuators in FIG. 14. As one hydraulic cylinder 710 retracts, the other hydraulic cylinder 710 correspondingly extends. As a hydraulic cylinder 710 retracts, it draws the movable side frame 706 to-wards its external adjustable mechanical limit stop. The other hydraulic cylinder 710 correspondingly extends and pushes the movable side frame 706 to-wards the external adjustable mechanical limit stop of the retracting hydraulic cylinder 710. As the hydraulic cylinder 710 continues to retract, the side frame 706 will come in contact with its adjustable mechanical limit stop. The adjustable mechanical limit stop is prevented form sliding along the movable side frame 706 by either a notch on the upper end of the movable side frame 706 or by the hydraulic cylinder 710 mounting on the lower end of the movable side frame 706. As the retracting hydraulic cylinder 710 retracts further, the movable side frame 706 will compress the adjustable mechanical limit stop. Compressing the adjustable mechanical limit stop will activate the associated limit sensor and open the fluid limit valve 551. The open fluid limit valve 551 of the associated retracted hydraulic cylinder allows fluid to flow into the base of the extending hydraulic cylinder 710. The hydraulic components used in the apparatus shown in FIG. 16 are external adjustable mechanical limit stops with associated limit sensors and fluid limit valves 551 and hydraulic cylinders 710. The hydraulic fluid flow between the hydraulic components shown in FIG. 16 is described in the operation of the hydraulic circuit shown in FIG. 14. Once the retracting hydraulic cylinder 710 has compressed its associated adjustable mechanical limit stop, it is prevented from further retracting further by the external mechanical limit stop. The external adjustable mechanical limit stops with associated limit sensor and fluid limit valve 551 prevents over retraction that could damage the side frames 706. Retraction limit of the external adjustable mechanical limit stops is adjustable by the operator as required to prevent damaging the side frames 706. Even though the two hydraulic cylinders are linked, relative piston displacements can be assumed. The length of the retracting hydraulic cylinder which causes the movable side frame 706 to reach its minimum safe distance from the fixed side frame 706 is unknown. In this apparatus shown in FIG. 16, the extending hydraulic cylinder 706 is not prevented by the fluid limit valve from attempting to extend further after the retraction hydraulic cylinder 706 has reached its retraction limit. Activating the fluid limit valve 551 to prevent further retraction of the retracting hydraulic cylinder 706 is not sufficient to prevent the two side frames 706 from becoming too close. The external adjustable mechanical limit stop mechanically prevents the two side frames 706 from becoming too close. This apparatus serves as an example of the operation and usage of external adjustable mechanical limit stops with associated limit sensors and fluid limit valves 551. In this apparatus shown in FIG. 16, hydraulic cylinders with external adjustable mechanical limit stops are advantageous over hydraulic cylinders with integrated adjustable mechanical limit stops. The maximum wheel steering angle of many vehicles is a function of the vehicle ride height and tire size. External adjustable mechanical limit stops with associated limit sensors and fluid limit valves 551 can be incorporated into the hydraulic steering circuit of such vehicles. By means of the external adjustable mechanical limit stop, the steering limits determined by the vehicle ride height and tire size can be statically or dynamically adjusted to prevent damaging scrubbing between tire and vehicle body.

CONCLUSION, RAMIFICATIONS, AND SCOPE

Accordingly, the reader will see that prior art hydraulic circuits have not been able to fully replace mechanical linkages in precision applications. Precision applications where hydraulic circuits have not been able to fully replace mechanical linkages include vehicle steering and other systems requiring accurate reliable correlation which linkages provide. Mechanical linkages reliably correlate the movement of mechanical components. Hydraulic circuits used to replace mechanical linkages use two or more linear actuators, rotary actuators or fluid motors to control the movement of mechanical components. In a hydraulic circuit, these hydraulic actuators or motors are connected by a hydraulic fluid conduit with possible intermediary fluid control valves and fluid pumps. The hydraulic circuits used to replace mechanical linkages are hydraulic linkages. Replacing mechanical linkages with hydraulic linkages have significant advantages over mechanical linkages. Hydraulic conduits required to construct hydraulic linkages can be easily routed. Hydraulic circuits can easily switch operating modes. In each operation mode the hydraulic circuit can form a hydraulic linkage between a different set of mechanical components or the mechanical components can be controlled independently in a completely uncorrelated manner. To replace mechanical linkages, hydraulic circuits need to be able to detect and correct fluid loss in hydraulic linkages and require limit stops to prevent damaging over extension or over retraction. Through the use of limit sensors and fluid limit valves, the hydraulic linkage can include leakage compensation and leakage location detection and allow for accurate control over the extension and retraction of a piston in the fluid actuator. Mechanical stops prevent over extension and over retraction and are strong enough to resist the full force of the hydraulic actuator or the full force of the mechanical load. Conventional actuators include mechanical stops. However, the mechanical stops included in conventional actuators are not adjustable. Mechanical components in different orientations may require mechanical limit stops to be repositioned. Without adjustable mechanical actuator stops, actuator movement often cannot be stopped before damaging over extension or over retraction occurs.

To fully understand the advantages of a hydraulic linkage, some existing systems that could benefit from fluid linkages should be considered. Using a hydraulic circuit to construct a hydraulic linkage in a steering system has numerous advantages in that

- It permits a simplified vehicle design. With the hydraulic linkage, there is no need for a mechanical linkage to connect the operator's steering wheel with the vehicle's turning wheels and there is no need for a mechanical linkage to connect the left and right turning wheels together. Thus, the engineer has more flexibility on how turning wheels are attached to a vehicle.
- It permits a vehicle to be designed without the need to penetrate the body with a mechanical linkage because left and right turning wheels can be connected without a mechanical linkage. Thus, the body will be stronger and can easily be made airtight and waterproof.
- It permits a vehicle to be designed without the need to protect an external mechanical steering linkage from road hazards.
- It permits a vehicle to be designed without the need to accommodate the mechanical steering linkage.
- It permits a vehicle to be designed without a collapsible steering linkage because no mechanical linkage is required between the operator's steering wheel and the vehicle's turning wheels.
- It permits a trailer to follow in the tracks of the towing vehicle because trailer wheels can easily be steered in coordination with the vehicle. Thus, there is a reduced turning radius and much improved handling with no need to take wide turns around corners.
- It permits coordination of the turning wheels of the trailer with the turning wheels of the vehicle. Also, it is easy to disable the coordination by disconnecting couplings or stopping fluid flow through valves.
- It permits coordinated turning of the vehicle and turning of the trailer, so the trailer tracks the same wheel path as the vehicle. This allows for different modes of operation to be selected depending on the speed of the vehicle or the desired handling characteristics of the operator, whereas a mechanical linkage system can only be efficiently designed for one mode of operation.
- It permits the steering system to be designed such that on soft surfaces, the trailer wheels can be designed to track the vehicle wheels. Substantially less pulling power is required when the trailer follows in the path already cut by the pulling vehicle.
- It permits the steering system to be designed such that when passing a vehicle, the trailer wheels will steer with the vehicle wheels to a lesser degree to reduce vehicle spinning, fishtailing, and jackknifing induced by lane changes.
- It permits the steering system to be designed such that when parking a vehicle, the trailer wheels can be steered in the same direction as the vehicle wheels or in the opposite direction of the vehicle wheels. Also, the trailer wheels can be left stationary. This versatility allows much greater mobility of the vehicle and trailer in parking.
- Similarly, it permits the vehicle to have front and rear attachments like a snowplow, snowblower, or lawn mower that can also be steered.
- It permits two or more vehicles to be hooked together and the steering of all of these can be coordinated.
- It permits complete redundancy in the steering system through identical but independent fluid linkage circuits.

The advantages of using a hydraulic linkage for self-levelling are as follows:

- It permits a simpler and more cost effective design with no mechanical linkage required.
- It permits a bucket tip hydraulic cylinder at the end of a telescopic loader to be connected to hydraulic lift cylinders through a fluid linkage.
- It permits design of a self-levelling system with a multiple piece lift arm. Several hydraulic lift cylinders will be used to control the multiple piece lift arm. The fluid displaced by these multiple hydraulic lift cylinders from the multiple piece lift arm can be combined to control the self-levelling bucket tip hydraulic cylinder.

It permits self-correction for fluid leakage, unlike conventional hydraulic flow divider valves that require adjustment and tuning.

It permits the operator to feel a feed load on the control actuator proportional to servomotor actuator load.

It permits a vehicle operator to detect a reduction of wheel grip on the road through the ability to feel the load on the vehicle turning wheels. Thus, the driver has better vehicle control and can prevent skidding more effectively.

It permits an operator to control and prevent stall through the ability to feel the load on aerodynamic control surfaces.

It permits a crane or excavator operator to perform very delicate work safely through the ability to feel load.

Although the above description contains many specificities, these should not be construed as limiting on the scope of the invention, but as merely providing illustrations of some of the presently preferred embodiments of this invention. Many other variations are possible. For example, all embodiments using linear fluid actuators with pistons moving linearly within a cylinder can equivalently use rotary fluid actuators with vanes rotating within a cylinder. Also, a fluid actuator with adjustable mechanical limits having one or more additional piston (690, 691), which have an adjustable separation from the main piston (102), can be equivalent constructed from multiple standard fluid actuators and motors. A standard fluid actuator or motor without limit sensors or fluid limit valves provides the function of the main piston (102). When the limit sensors are activated, fluid limit valves (550, 551) open and allow fluid to bypass this fluid actuator or motor in the same manner as the main piston (102) was bypassed. If adjustable mechanical limit stops are not required, no additional fluid actuators are required. Standard fluid actuator or motor along with limit sensors and fluid limit valves is sufficient. Also, where hydraulic fluid is used in the embodiments any other incompressible fluid could alternately be used in place of the hydraulic fluid.

If adjustable mechanical limit stops are required, additional fluid actuators can be used to replace the adjustable mechanical limit stops. The additional fluid actuator to be used as an adjustable mechanical limit stop is connected in the appropriate location as required to stop movement of the mechanical components. The piston inside the cylinder of the fluid actuator operating as an adjustable mechanical limit stop will extend and retract freely until it is prevented from extending further by the fluid between the piston and the cylinder head, or it is prevented from retracting further by the fluid between the piston and the cylinder base. By adjusting the amount of fluid between the piston and the cylinder head and between the piston and the cylinder base, the limits of extension and retraction of the fluid actuator operating as an adjustable mechanical limit stop are adjusted. The fluid actuator operating as an adjustable mechanical limit stop is mounted with limit sensor. When the piston of this fluid actuator is prevented from extending further by the fluid between the piston and the cylinder head, or it is prevented from retracting further by the fluid between the piston and the cylinder base, it applies force to the limit sensor. When force is applied to the limit sensor used with a fluid actuator containing incompressible fluid operating as an adjustable mechanical limit stop, the limit sensor activates. Fluid limit valves open when the limit sensor is activated as described in the embodiment of the hydraulic cylinder with additional pistons. When force is applied to the limit sensor used with a fluid actuator containing compressible fluid operating as an adjustable mechanical limit damper, the limit sensor activate in proportion to the applied force. Fluid limit valves open in proportion to the degree the limit sensors are activated, when the limit sensor is activated as described in the embodiment of the hydro-pneumatic cylinder with additional pistons. The additional piston provided by the fluid actuator operation as an adjustable mechanical limit stop is equivalent to the additional piston (690, 691) of the preferred embodiment of fluid actuator with adjustable mechanical limits. Described component embodiments may be assembled to form a variety of embodiments equivalent to the presented preferred embodiment of the fluid actuator with adjustable mechanical limits.

If a servomechanism with adjustable limits is required, the fluid actuators 320 and 322 are connected to form a fluid linkage servo feedback control. In such a servomechanism, the operator controls the position of one fluid actuator 320, and the other fluid actuator 322 is attached by a mechanical or magnetic connection to the drive actuator. Fluid conduits 911, 915 are further connected to servo drive valve actuators. As a typical servomechanism, when the feedback actuator 322 does not track the movement of the control actuator 320, fluid displaces the servo drive valve actuators. The servo drive valve actuators act on the drive actuator's control valve which in turn causes the drive actuator and connected feedback actuator 322 to move such that the feedback actuator 322 tracks the position of the control actuator 320. The adjustable limits of the control actuator 320 limit the maximum extension and retraction of the drive actuator by means of the servomechanism.

The fluid limit valves 550, 551 are either normally closed or normally open. When normally closed, they open when activated by limit sensors 344, 345. When normally open, they close when activated by limit sensors 344, 345. Normally open and normally closed fluid limit valves 550, 551 can be used in combination or separately. A hydraulic linkage actuator incorporating adjustable soft limit stops will include either a floating piston, with a gas damping valve, subdividing the outer head gas chamber 650 or an additional pneumatic actuator connected by a fluid linkage to the outer gas chamber 650 containing a floating piston. The floating piston activates a normally open fluid limit valve. As the main piston 102 approaches its retraction limit, the gas in the subdivided head gas chamber 650 compresses in proportion to the applied force. As the gas in the head gas chamber 650 compresses, the floating piston proportionally retracts and activates the normally open fluid limit valve. Activation of the normally open fluid limit valve results in restricted fluid flow through it. As the main piston 102 approaches its retraction limit, the normally open fluid limit valve is progressively activated. This restricts fluid flow, thereby resulting in a reduced retraction speed and reduced applied impact force between the base cap 682 and pistons.

Thus the scope of the invention should be determined not by the embodiments illustrated, but by the appended claims and their legal equivalents.

What is claimed is:

1. A fluid actuator with adjustable limits comprising:

a. a cylinder, b. a main piston inside said cylinder, c. a means of transferring mechanical load to said main piston extending out of one or both ends of said cylinder, d. one or more additional pistons, e. fluid between said additional pistons and said main piston, and f. a means of using said fluid with one or more said additional pistons to adjust the extension and/or retraction limits of said main piston and/or resisting force applied on said main piston, whereby the extension and/or retraction limits of said main piston inside said cylinder are adjustable by the amount of incompressible said fluid between one or more said additional pistons and said main piston, whereby as said main piston inside said cylinder approaches the extension limit, its extension speed and/or applied force is controlled by an adjustable amount according to the amount of compressibility of said fluid between one or more said additional pistons and said main piston inside said cylinder, whereby as said main piston inside said cylinder approaches the retraction limit, its retraction speed and/or applied force is controlled by an adjustable amount according to the amount of compressibility of said fluid between one or more said additional pistons and said main piston inside said cylinder.

2. The fluid actuator of claim 1, further including:

a. a means of activating one or more fluid limit valves when said main piston is extended to its extension limit or when said main piston is retracted to its retraction limit, and b. one or more said fluid limit valves that open when activated to allow fluid to bypass said main piston, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

3. The fluid actuator of claim 2 wherein said fluid valves are constructed as bypass fluid outlets, such that when said main piston is extended to its extension limit or said main piston is retracted to its retraction limit, one or more said additional pistons passes over said bypass fluid outlets, thereby allowing fluid to bypass said main piston, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

4. The fluid actuator of claim 2 wherein one or more limit sensors are used for said means of activating said fluid limit valves, such that when said main piston is extended to its extension limit and/or when said main piston is retracted to its retraction limit, it activates one or more limit sensors for each extension and/or retraction limit, such that when one or more said limit sensors are activated, corresponding said fluid limit valves open, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

5. The fluid actuator of claim 2 wherein:

a. said fluid is incompressible, b. said means of using said fluid with one or more said additional pistons to adjust the extension and/or retraction limit of said main piston by adjusting the amount of incompressible said fluid between one or more said additional pistons and end of said cylinder and/or by adjusting the amount of incompressible said fluid between one or more said additional pistons inside an additional cylinder and end of said additional cylinder and/or by adjusting the amount of incompressible said fluid between one or more said additional pistons and said main piston, such that the minimum separation between one or more said additional pistons and end of said cylinder and/or the minimum separation between one or more said additional pistons inside said additional cylinder and end of said additional cylinder and/or the minimum separation between one or more said additional pistons and said main piston is adjusted by the amount of incompressible said fluid, such that one or more said additional pistons activate said fluid limit valves for each extension or retraction limit, and such that activated said fluid limit valves allow fluid to bypass said main piston, whereby the extension and retraction limits of said main piston are adjustable by the amount of incompressible fluid between said piston inside said additional cylinder, whereby the extension and retraction limits of said main piston are adjustable by the amount of incompressible fluid between said piston inside said additional cylinder and end of said additional cylinder, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

6. The fluid actuator of claim 2, further including fluid conduits, such that said fluid actuator is connected to one or more said fluid actuators by incompressible said fluid flowing through said fluid conduits, and such that when said fluid limit valves are activated, they allow incompressible said fluid to bypass said main piston and flow out of said fluid actuator through said fluid conduits into another said fluid actuator with possible intermediary fluid control valves and fluid pumps, whereby when two or more said fluid actuators are connected by incompressible fluid flowing through said fluid conduits, they will have their main piston motion forcibly correlated by incompressible said fluid bypassing said main pistons by means of one or more said fluid limit valves activating at adjustable extension and/or retraction limits, whereby when two or more said fluid actuators are connected by incompressible said fluid flowing through said fluid conduits, incompressible fluid loss is compensated for at adjustable extension and/or retraction limits, whereby the need for immediate incompressible fluid loss maintenance is reduced or eliminated, and whereby the detected incompressible fluid loss provides an indication of when and where incompressible said fluid loss maintenance is required.

7. The fluid actuator of claim 6 further including one or more fluid inlets into each said fluid limit valve, such that when said fluid limit valves are activated, said fluid limit valves open said fluid inlet(s) and incompressible fluid flows through said fluid inlet(s) and into said fluid conduit, thereby compensating for incompressible fluid loss at limit positions of said main pistons of said fluid actuators, and such that said main pistons of said fluid actuators are put in the correct relative positions, whereby when two or more said fluid actuators are connected by incompressible fluid flowing through said fluid conduits, they will have their main piston motion forcibly correlated by incompressible said fluid bypassing said main pistons by means of one or more said fluid limit valves activating at adjustable extension and/or retraction limits, whereby when two or more said fluid actuators are connected by incompressible said fluid flowing through said fluid conduits, incompressible said fluid loss is compensated for at adjustable extension and/or retraction limits, whereby the need for immediate incompressible fluid loss maintenance is reduced or eliminated, and whereby the detected incompressible fluid loss provides an indication of when and where incompressible said fluid loss maintenance is required.

8. The fluid actuator of claim 1 wherein:

a. said fluid is incompressible, and b. said means of using said fluid with one or more said additional pistons to adjust the extension and/or retraction limit of said main piston by adjusting the amount of incompressible said fluid between one or more said additional pistons and end of said cylinder and/or by adjusting the amount of incompressible said fluid between one or more said additional pistons inside an additional cylinder and end of said additional cylinder and/or by adjusting the amount of incompressible said fluid between one or more said additional pistons and said main piston, such that the minimum separation between one or more said additional pistons and end of said cylinder and/or the minimum separation between one or more said additional pistons inside said additional cylinder and end of said additional cylinder and/or the minimum separation between one or more said additional pistons and said main piston is adjusted by the amount of incompressible said fluid, whereby the extension and retraction limits of said main piston inside said cylinder are adjustable by the amount of incompressible fluid between one or more said additional pistons inside said cylinder and said main piston inside said cylinder, and whereby the extension and retraction limits of said main piston are adjustable by the amount of incompressible fluid between one or more said additional pistons inside said cylinder and end of said cylinder.

9. The fluid actuator of claim 1, further including:

a. a means of activating fluid limit valves when said main piston is extended to its extension limit or when said main piston is retracted to its retraction limit, and b. one or more said fluid limit valves that close when activated to restrict fluid flow into or out of said cylinder, whereby as said main piston inside said cylinder approaches the adjustable retraction limit, its retraction speed and/or applied force is reduced, and whereby as said main piston inside said cylinder approaches the adjustable extension limit, its extension speed and/or applied force is reduced.

10. The fluid actuator of claim 9 wherein:

a. said fluid is compressible, b. said means of using compressible said fluid with one or more said additional pistons and said main piston to adjust the resisting force applied on said main piston by adjusting the amount of compressible said fluid between said additional pistons inside said cylinder and end of said cylinder and/or between said additional pistons inside an additional cylinder and end of said additional cylinder and/or between said additional pistons and said main piston, c. said means of activating said fluid limit valves when said main piston is extended to its extension limit or when said main piston is retracted to its retraction limit by one or more said additional piston activating said fluid limit valves, such that one or more said additional pistons activate one or more said fluid limit valves, which in turn restricts fluid flow, whereby the activation of said fluid limit valves cushions said main piston at adjustable limits, whereby as said main piston inside said cylinder approaches the extension limit, its extension speed and/or applied force is reduced by an adjustable amount according to the amount of compressible said fluid between one or more said additional pistons and end of said cylinder and/or between one or more said additional pistons inside said additional cylinder and end of said additional cylinder and/or between said additional pistons and said main piston, and whereby as said main piston inside said cylinder approaches the retraction limit, its retraction speed and/or applied force is reduced by an adjustable amount according to the amount of compressible said fluid between one or more said additional pistons and end of said cylinder and/or between one or more said additional pistons inside said additional cylinder and end of said additional cylinder and/or between said additional pistons and said main piston.

11. The fluid actuator of claim 9 wherein:

a. said fluid is compressible, b. said means of using said fluid with one or more said additional pistons and said main piston to adjust the resisting force applied on said main piston by adjusting the amount of compressible said fluid in two or more chambers between said additional pistons and end of said cylinder and/or between said additional pistons inside an additional cylinder and end of said additional cylinder and/or between said additional pistons and said main piston, such that one or more said additional pistons, which subdivide compressible said fluid into two or more said chambers, move in proportion to the force applied, which results in compression of said fluid, c. said means of activating said fluid limit valves when said main piston is extended to its extension limit or when said main piston is retracted to its retraction limit by one or more said additional pistons, which subdivide compressible said fluid into two or more said chambers, activating said fluid limit valves, such that one or more said additional pistons activate one or more said fluid limit valves, which in turn restricts fluid flow, whereby as said main piston inside said cylinder approaches the extension limit, its extension speed and/or applied force is reduced by an adjustable amount according to the amount of compressible said fluid between one or more said additional pistons and end of said cylinder and/or between one or more said additional pistons inside said additional cylinder and end of said additional cylinder and/or between said additional pistons and said main piston, whereby as said main piston inside said cylinder approaches the retraction limit, its retraction speed and/or applied force is reduced by an adjustable amount according to the amount of compressible said fluid between one or more said additional pistons and end of said cylinder and/or between one or more said additional pistons inside said additional cylinder and end of said additional cylinder and/or between said additional pistons and said main piston, and whereby the activation of said fluid limit valves cushions said main piston at adjustable limits in proportion to the amount of compressible said fluid between one or more said additional pistons and end of said cylinder and/or between one or more said additional pistons inside said additional cylinder and end of said additional cylinder and/or between said additional pistons and said main piston.

12. A method of adjusting the extension and/or retraction limits of a fluid actuator, comprising the steps of:

a. transferring mechanical load to and from a main piston inside a cylinder through one or both ends of said cylinder, and b. adjusting extension and/or retraction limits of said main piston and/or resisting force applied onto said main piston through the use of fluid and one or more additional pistons, whereby the extension and/or retraction limits of said main piston inside said cylinder are adjustable by the amount of incompressible said fluid between one or more said additional pistons and said main piston, whereby as said main piston inside said cylinder approaches the extension limit, its extension speed and/or applied force is controlled by an adjustable amount according to the amount of compressibility of said fluid between one or more said additional pistons and said main piston inside said cylinder, and whereby as said main piston inside said cylinder approaches the retraction limit, its retraction speed and/or applied force is controlled by an adjustable amount according to the amount of compressibility of said fluid between one or more said additional pistons and said main piston inside said cylinder.

13. The method of claim 12, for adjusting the extension and/or retraction limits of said fluid actuator, further including a method of fluid bypassing said main piston, comprising the additional steps of:

a. activating one or more fluid limit valves when said main piston is extended to its extension limit or when said main piston is retracted to its retraction limit, and b. opening said fluid limit valves when activated to allow fluid to bypass said main piston, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

14. The method of claim 13, for adjusting the extension and/or retraction limits of said fluid actuator with fluid limit valves, wherein said fluid bypasses said main piston, comprises the step of extending said main piston to its extension limit or retracting said main piston to its retraction limit, which causes one or more said additional pistons to pass over bypass fluid outlets, thereby activating fluid limit valves and allowing fluid to bypass said main piston, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

15. The method of claim 13, for adjusting the extension and/or retraction limits of said fluid actuator with fluid limit valves, wherein said fluid bypassing said main piston, comprises the steps of:

a. activating one or more limit sensors when said main piston is at its extension or retraction limit, b. opening one or more said fluid limit valves when said one or more said limit sensors are activated, which allows said fluid to bypass said main piston, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

16. The method of claim 12, for adjusting the extension and/or retraction limits of said fluid actuator, wherein adjusting extension and/or retraction limits of said main piston, comprises the steps of:

a. adjusting the amount of incompressible said fluid between one or more said additional pistons and end of said cylinder and/or between one or more said additional pistons inside an additional cylinder and end of said additional cylinder and/or between one or more said additional pistons and said main piston, such that the minimum separation between one or more said additional pistons and end of said cylinder and/or the minimum separation between one or more said additional pistons inside said additional cylinder and end of said additional cylinder and/or the minimum separation between one or more said additional pistons and said main piston is adjusted by the amount of incompressible said fluid, b. extending said main piston towards its extension limit or retracting said main piston towards its retraction limit, thereby causing one or more said additional pistons to extend toward the extension limit or retract toward the retraction limit, such that the extension and/or retraction limit of one or more said additional pistons determines the extension and/or retraction limit of said main piston, whereby the extension and retraction limits of said main piston inside said cylinder are adjustable by the amount of incompressible fluid between one or more said additional pistons inside said cylinder and said main piston inside said cylinder, and whereby the extension and retraction limits of said main piston are adjustable by the amount of incompressible fluid between one or more said additional pistons inside said cylinder and end of said cylinder.

17. The method of claim 12, for adjusting the extension and/or retraction limits of said fluid actuator, wherein adjusting extension and/or retraction limits of said main piston, comprises the steps of:

a. adjusting the amount of incompressible said fluid between one or more said additional pistons and end of said cylinder and/or between one or more said additional pistons inside an additional cylinder and end of said additional cylinder and/or between one or more said additional pistons and said main piston, such that the minimum separation between one or more said additional pistons and end of said cylinder and/or the minimum separation between one or more said additional pistons inside said additional cylinder and end of said additional cylinder and/or the minimum separation between one or more said additional pistons and said main piston is adjusted by the amount of incompressible said fluid, b. extending said main piston towards its extension limit or retracting said main piston towards its retraction limit, thereby causing one or more said additional pistons to extend toward the extension limit or retract toward the retraction limit, such that the extension and/or retraction limit of one or more said additional pistons determines the extension and/or retraction limit of said main piston, c. activating said fluid limit valves at extension and/or retraction limits by one or more said additional pistons, such that activated said fluid limit valves allow fluid to bypass said main piston, whereby the extension and retraction limits of said main piston are adjustable by the amount of incompressible fluid between said piston inside said additional cylinder, whereby the extension and retraction limits of said main piston are adjustable by the amount of incompressible fluid between said piston inside said additional cylinder and end of said additional cylinder, whereby fluid bypassing said main piston of said fluid actuator prevents said main piston from extending or retracting too hard against the cylinder ends, whereby the need for immediate incompressible fluid loss maintenance is reduced or eliminated, and whereby the detected incompressible fluid loss provides an indication of when and where incompressible fluid loss maintenance is required.

18. The method of claim 12, for adjusting the extension and/or retraction limits of said fluid actuator, further including a method of providing adjustable cushioned extension and/or retraction limits, comprising the additional steps of:

a. activating one or more fluid limit valves when said main piston is extended to its extension limit or when said main piston is retracted to its retraction limit, and b. closing said fluid limit valves when activated to restrict fluid flow into and out of said cylinder, whereby as said main piston inside said cylinder approaches the adjustable retraction limit, its retraction speed and/or applied force is reduced, and whereby as said main piston inside said cylinder approaches the adjustable extension limit, its extension speed and/or applied force is reduced.

19. The method of claim 18, for adjusting the extension and/or retraction limits of said fluid actuator, wherein fluid flow is restricted into and out of said cylinder, comprises the steps of:

a. adjusting the amount of compressible said fluid between one or more said additional pistons inside said cylinder and end of said cylinder and/or between one or more said additional pistons inside an additional cylinder and end of said additional cylinder and/or between one or more said additional pistons and said main piston, b. activating said fluid limit valves by one or more said additional piston activating said fluid limit valves when said main piston is extended to its extension limit or when said main piston is retracted to its retraction limit, c. closing one or more said fluid limit valves when one or more said limit sensors are activated, which restricts fluid flow into and out of said cylinder, whereby the activation of said fluid limit valves cushions said main piston at adjustable limits, whereby as said main piston inside said cylinder approaches the extension limit, its extension speed and/or applied force is reduced by an adjustable amount according to the amount of compressible said fluid between one or more said additional pistons and end of said cylinder and/or between one or more said additional pistons inside said additional cylinder and end of said additional cylinder and/or between said additional pistons and said main piston, and whereby as said main piston inside said cylinder approaches the retraction limit, its retraction speed and/or applied force is reduced by an adjustable amount according to the amount of compressible said fluid between one or more said additional pistons and end of said cylinder and/or between one or more said additional pistons inside said additional cylinder and end of said additional cylinder and/or between said one or more additional pistons and said main piston.

20. The method of claim 18, for adjusting the extension and/or retraction limits of said fluid actuator, wherein fluid flow is restricted into and out of said cylinder, comprises the steps of:

a. adjusting the amount of compressible said fluid in two or more chambers between one or more said additional pistons and end of said cylinder and/or between one or more said additional pistons inside an additional cylinder and end of said additional cylinder and/or between said one or more additional pistons and said main piston, such that one or more said additional pistons, which subdivide compressible said fluid into two or more said chambers, move in proportion to the force applied, which results in compression of said fluid, b. activating said fluid limit valves by one or more said additional pistons, which subdivide compressible said fluid into two or more said chambers when said main piston is extended toward its extension limit or when said main piston is retracted toward its retraction limit, c. closing one or more said fluid limit valves when one or more said limit sensors are activated, which restricts fluid flow into and out of said cylinder, whereby the activation of said fluid limit valves cushions said main piston at adjustable limits, whereby as said main piston inside said cylinder approaches the extension limit, its extension speed and/or applied force is reduced by an adjustable amount according to the amount of compressible said fluid between one or more said additional pistons and end of said cylinder and/or between one or more said additional pistons inside said additional cylinder and end of said additional cylinder and/or between said one or more additional pistons and said main piston, and whereby as said main piston inside said cylinder approaches the retraction limit, its retraction speed and/or applied force is reduced by an adjustable amount according to the amount of compressible said fluid between one or more said additional pistons and end of said cylinder and/or between one or more said additional pistons inside said additional cylinder and end of said additional cylinder and/or between said one or more additional pistons and said main piston.

21. The method of claim 12, for connecting two or more said fluid actuators, comprising the additional steps of:

a. correlating said main pistons of said fluid actuators by incompressible said fluid flowing out of said fluid actuator through fluid conduits into another said fluid actuator with zero, one, or more intermediary fluid control valves and zero, one, or more intermediary fluid pumps, b. opening one or more said fluid limit valves to allow said fluid to bypass said main piston of said fluid actuator and flow through said fluid conduits into another said fluid actuator with zero, one, or more intermediary said fluid control valves and zero, one, or more intermediary said fluid pumps, whereby when two or more said fluid actuators are connected by incompressible fluid flowing through said fluid conduits, they will have their main piston motion forcibly correlated by incompressible said fluid bypassing said main pistons by means of one or more said fluid limit valves activating at adjustable extension and/or retraction limits, whereby when two or more said fluid actuators are connected by incompressible said fluid flowing through said fluid conduits, incompressible fluid loss is compensated for at adjustable extension and/or retraction limits, whereby the need for immediate incompressible fluid loss maintenance is reduced or eliminated, and whereby the detected incompressible fluid loss provides an indication of when and where incompressible said fluid loss maintenance is required.

22. The method of claim 21, for connecting two or more said fluid actuators, wherein said fluid limit valves contain one or more fluid inlets, comprising the additional step of opening one or more said fluid inlets into said fluid limit valves when said fluid limit valves are activated, such that incompressible said fluid flows through one or more said fluid inlets and into said fluid conduits, thereby compensating for incompressible said fluid loss at limit positions of said main pistons of said fluid actuators, whereby when two or more said fluid actuators are connected by incompressible fluid flowing through said fluid conduits, they will have their main piston motion forcibly correlated by incompressible said fluid bypassing said main pistons by means of one or more said fluid limit valves activating at adjustable extension and/or retraction limits, whereby when two or more said fluid actuators are connected by incompressible said fluid flowing through said fluid conduits, incompressible said fluid loss is compensated for at adjustable extension and/or retraction limits, whereby the need for immediate incompressible fluid loss maintenance is reduced or eliminated, and whereby the detected incompressible fluid loss provides an indication of when and where incompressible said fluid loss maintenance is required.

* * * * *